US009539832B2

(12) United States Patent
Sasaki

(10) Patent No.: US 9,539,832 B2
(45) Date of Patent: Jan. 10, 2017

(54) TAPE CARTRIDGE AND TAPE PRINTING APPARATUS

(71) Applicant: Seiko Epson Corporation, Tokyo (JP)

(72) Inventor: Taishi Sasaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/777,527

(22) PCT Filed: Mar. 20, 2014

(86) PCT No.: PCT/JP2014/001650
§ 371 (c)(1),
(2) Date: Sep. 16, 2015

(87) PCT Pub. No.: WO2014/148060
PCT Pub. Date: Sep. 25, 2014

(65) Prior Publication Data

US 2016/0297217 A1 Oct. 13, 2016

(30) Foreign Application Priority Data

Mar. 21, 2013 (JP) ..... 2013-058868
Oct. 4, 2013 (JP) ..... 2013-209713

(51) Int. Cl.
*B41J 25/304* (2006.01)
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 13/00; B41J 13/0009; B41J 15/00; B41J 15/04; B41J 15/044; B41J 15/046; B41J 25/304; B41J 25/308; B41J 25/3082; B41J 3/4075
See application file for complete search history.

(56) References Cited

U.S. PATENT DOCUMENTS 5,350,243 A 9/1994 Ichinomiya et al.
5,474,394 A * 12/1995 Koike ..... B41J 25/304 400/120.04

(Continued)

FOREIGN PATENT DOCUMENTS

JP 5-185679 A 7/1993
JP 10-157235 A 6/1998
JP 2014-030915 A 2/2014

OTHER PUBLICATIONS

Search Report received in International Application No. PCT/JP2014/001650, Jun. 17, 2014.

*Primary Examiner* — Kristal Feggins
(74) *Attorney, Agent, or Firm* — ALG Intellectual Property, LLC

(57) ABSTRACT

Provided is a tape cartridge that prevents a print tape from becoming wrinkled while preventing the tip end of a tape-shaped member from getting in a cartridge case, or the like. The tape cartridge has a cartridge case, a label tape 101 accommodated in the cartridge case so as to be capable of being paid out, a platen roller 103 that is rotatably accommodated in the cartridge case so as to be brought into rolling-contact with the side of the release tape of the label tape 101 and moves within a prescribed range in a tape feed direction as the label tape 101 is fed out and drawn, and a drawing prevention portion 138 that contacts the side of the print tape of the label tape 101 and holds the label tape 101 between the drawing prevention portion 138 and a platen roller 103 when the platen roller moves to an upstream side in the tape feed direction as the label tape 101 is drawn, wherein the drawing prevention portion 138 does not contact one side in the tape width direction of the label tape 101.

13 Claims, 18 Drawing Sheets

(56) References Cited

U.S. PATENT DOCUMENTS

| | | | | | |
|---|---|---|---|---|---|
| 6,007,263 | A | * | 12/1999 | Imai | B41J 25/304 400/55 |
| 6,113,292 | A | * | 9/2000 | Unno | B41J 25/304 400/578 |
| 2014/0037359 | A1 | | 2/2014 | Nakajima et al. | |

* cited by examiner

[RELATED ART]

[RELATED ART]

[RELATED ART]

TAPE CARTRIDGE AND TAPE PRINTING APPARATUS

TECHNICAL FIELD

The present invention relates to a tape cartridge installed in a tape printing apparatus having a print head that performs printing on a print tape and to the tape printing apparatus.

BACKGROUND ART

Conventionally, there has been known a tape cartridge installed in a tape writer having a print head, the tape cartridge including a cartridge case, a tape-shaped member having a release tape affixed to the rear side of a print tape and accommodated in the cartridge case so as to be capable of being paid out, and a platen rotatably accommodated in the cartridge case on the side of the release tape of the tape-shaped member and feeds by rotation the tape-shaped member held between the platen and the print head. In addition, the tape cartridge includes a tape guide pin at a position upstream of the platen in a tape feed direction and on the side of the print surface of the tape. The tape guide pin projects from the bottom wall of the tape cartridge with its tip end fitting in a top wall and contacts the tape over the whole tape width. In the tape cartridge configured as described above, the tape is held between the platen and the tape guide pin when the platen moves to an upstream side in the tape feed direction as the tape is drawn, whereby the tape is not further drawn. As a result, the tip end of the tape is prevented from getting in the cartridge case (see, for example, Patent Document 1). In the tape cartridge, the tape is curved like an "S"-shape in its front and rear direction over the whole tape width on the feed path from the tape guide pin to the platen.

In addition, the present applicant has proposed a sheet cartridge installed in a tape printing apparatus provided with a light sensor having a light-emission element and a light-reception element facing each other, the sheet cartridge including a label sheet having a plurality of label-position detection convex pieces obtained by making its one side in a sheet width direction partially laterally projected in the sheet width direction, and a cartridge case in which the label sheet is accommodated so as to be capable of being paid out, wherein the outer surface of the cartridge case has an area in which the plurality of label-position detection convex pieces is exposed one after another for detection by a light sensor as the tape-shaped member is paid out (see Patent Document 2).

[Patent Document 1] JP-A-10-157235

[Patent Document 2] JP-A-2012-171079

In the conventional tape cartridge, the platen (platen roller) and the tape guide pin (drawing prevention portion) are provided at positions at which they overlap with each other in a traverse direction traversing the tape feed path. Therefore, the tape-shaped member is curved like an "S"-shape over the whole tape width on the feed path from the tape guide pin to the platen.

However, the print tape is likely to be partially released from the release tape at the curved spot. Therefore, the print tape at the released spot (separated from the release tape) is folded to its rear surface side in a shrinking state in a length direction to make the rear surfaces affixed to each other. As a result, there is a likelihood that the print tape becomes wrinkled. If the print tape becomes wrinkled, printing cannot be appropriately performed on the print tape at the spot and also the wrinkle gets stuck on the tape delivery port of the cartridge case, which may cause a factor responsible for jamming.

In addition, when the respective detection convex portions of the tape-shaped member enter the light sensor in a state of being curved like an "S"-shape in the front and rear direction, there is a likelihood that the respective detection convex portions cannot appropriately enter the area between the light-emission element and the light-reception element of the light sensor compared with a case in which the respective detection convex portions enter the light sensor in a state of being formed into a linear shape.

The present invention has an object of providing a tape cartridge, which allows the respective detection convex portions of a tape-shaped member to appropriately enter the area between the light-emission element and the light-reception element of a light sensor and prevents a print tape from becoming wrinkled while preventing the tip end of the tape-shaped member from getting in the cartridge case, and a tape printing apparatus having the tape cartridge.

DISCLOSURE OF THE INVENTION

According to the present invention, there is provided a tape cartridge installed in a tape printing apparatus having a print head that performs printing on a print tape, the tape cartridge comprising: a cartridge case; a tape-shaped member that has the print tape and a release tape affixed to a rear side of the print tape and is accommodated in the cartridge case so as to be capable of being paid out; a platen roller that is rotatably accommodated in the cartridge case so as to be brought into rolling-contact with a side of the release tape of the tape-shaped member, feeds by rotation the tape-shaped member held between the platen roller and the print head, and moves within a prescribed range in a tape feed direction as the tape-shaped member is paid out and drawn; and a drawing prevention portion that is provided at a position upstream of the platen roller in the tape feed direction, overlaps with the platen roller in a traverse direction traversing a feed path of the tape-shaped member, contacts a side of the print tape of the tape-shaped member, and holds the tape-shaped member between the drawing prevention portion and the platen roller when the platen roller moves to an upstream side in the tape feed direction as the tape-shaped member is drawn, wherein the drawing prevention portion does not contact one side in a tape width direction of the tape-shaped member.

According to the configuration, the drawing prevention portion does not contact the one side in the tape width direction of the tape-shaped member but contacts only the other side in the tape width direction thereof. Therefore, on the feed path from the drawing prevention portion to the platen roller, the other side in the tape width direction of the tape-shaped member contacting the drawing prevention portion is curved like an "S"-shape, while the one side in the tape width direction thereof not contacting the drawing prevention portion is formed into a substantially linear shape (gentle arc shape). Accordingly, compared with a case in which the tape-shaped member is curved like an "S"-shape over the whole tape width, the print tape is hardly partially released from the release tape on the feed path from the drawing prevention portion to the platen roller, whereby the print tape is prevented from becoming wrinkled. In addition, in this case as well, the other side in the tape width direction of the tape-shaped member is held between the platen roller and the drawing prevention portion when a platen moves to the upstream side in the tape feed direction as the tape-shaped member is drawn. Therefore, the tip end of the tape-shaped member can be prevented from getting in the cartridge case. As a result, the print tape can be prevented from becoming wrinkled, while the tip end of the tape-shaped member is prevented from getting in the cartridge case.

In this case, the cartridge case preferably has a covering wall portion that covers an end surface on the other side in the tape width direction of the tape-shaped member, and the drawing prevention portion projects from the covering wall portion and is configured to be shorter than a tape width of the tape-shaped member.

According to the configuration, the drawing prevention portion can be prevented from contacting the one side in the tape width direction of the tape-shaped member without being configured in a complicated way.

According to the present invention, there is provided another tape cartridge installed in a tape printing apparatus having a print head that performs printing on a print tape, the tape cartridge comprising: a cartridge case; a tape-shaped member that has the print tape and a release tape affixed to a rear side of the print tape and is accommodated in the cartridge case so as to be capable of being paid out; a platen roller that is rotatably accommodated in the cartridge case so as to be brought into rolling-contact with a side of the release tape of the tape-shaped member, feeds by rotation the tape-shaped member held between the platen roller and the print head, and moves within a prescribed range in a tape feed direction as the tape-shaped member is paid out and drawn; and a drawing prevention portion that is provided at a position upstream of the platen roller in the tape feed direction, overlaps with the platen roller in a traverse direction traversing a feed path of the tape-shaped member, contacts a side of the print tape of the tape-shaped member, and holds the tape-shaped member between the drawing prevention portion and the platen roller when the platen roller moves to an upstream side in the tape feed direction as the tape-shaped member is drawn, wherein the drawing prevention portion projects from the cartridge case and is configured to be capable of elastically tilting to a side opposite to the platen roller in the traverse direction.

According to the configuration, since the drawing prevention portion projecting from the covering wall portion is configured to be capable of elastically tilting to the side opposite to the platen roller in the traverse direction, the drawing prevention portion is pressed by the fed tape-shaped member to tilt to the side opposite to the platen roller when the tape-shaped member is fed. Therefore, on a feed path from the drawing prevention portion to the platen roller, the other side (opposite to the one side) in the tape width direction corresponding to the base-end side of the drawing prevention portion is curved like an "S"-shape, while the one side in the tape width direction corresponding to the tip-end side of the drawing prevention portion is formed into a substantially linear shape (gentle arc shape). Accordingly, compared with a case in which the tape-shaped member is curved like an "S"-shape over the whole tape width, the print tape is hardly partially released from the release tape on the feed path from the drawing prevention portion to the platen roller, whereby the print tape is prevented from becoming wrinkled. In addition, in this case as well, the tape-shaped member is held between the platen roller and the drawing prevention portion when a platen moves to the upstream side in the tape feed direction as the tape-shaped member is drawn. Therefore, the tip end of the tape-shaped member can be prevented from getting in the cartridge case. As a result, the print tape can be prevented from becoming wrinkled, while the tip end of the tape-shaped member is prevented from getting in the cartridge case.

According to the present invention, there is provided another tape cartridge installed in a tape printing apparatus, the tape cartridge comprising: a tape-shaped member having a plurality of detection convex portions that partially projects from one end in a tape width direction; a cartridge case that has a first wall portion and a second wall portion facing each other and accommodates the tape-shaped member so as to make a side of the one end of the tape-shaped member positioned on a side of the first wall portion and make a side of the other end thereof positioned on a side of the second wall portion; a platen roller that serves as a roller rotatably accommodated in the cartridge case and paying out the tape-shaped member by rotation and is movable to an upstream side in a paying-out direction of the tape-shaped member as the tape-shaped member is drawn; and a drawing prevention portion that projects from the second wall portion at a position upstream of the platen roller in the paying-out direction of the tape-shaped member and holds the tape-shaped member between the drawing prevention portion and the platen roller when the platen roller moves to the upstream side in the paying-out direction of the tape-shaped member as the tape-shaped member is drawn, wherein the drawing prevention portion does not contact the detection convex portions.

According to the configuration, on a path from the drawing prevention portion to the platen roller, a portion of the tape-shaped member contacting the drawing prevention portion is curved like an "S"-shape in a front and rear direction, while the detection convex portions do not contact the drawing prevention portion and are formed into a substantially linear shape, for example, a gentle arc shape. Accordingly, the respective detection convex portions enter a light sensor positioned in an exposed area in a state of being formed into a substantially linear shape and can appropriately enter the area between the light-emission element and the light-reception element of the light sensor compared with a case in which the respective detection convex portions enter the light sensor in a state of being curved like an "S"-shape.

In this case, the drawing prevention portion does not preferably contact the first wall portion.

In this case, the drawing prevention portion is preferably configured such that a tip end thereof is capable of elastically tilting in a direction away from the tape-shaped member.

According to the configuration, since the drawing prevention portion is configured to be capable of elastically tilting in the direction away from the tape-shaped member, the drawing prevention portion is pressed by the fed tape-shaped member to tilt to the direction away from the tape-shaped member when the tape-shaped member is fed. Thus, on the feed path from the drawing prevention portion to the roller, the other side in the tape width direction corresponding to the base-end side of the drawing prevention portion is curved like an "S"-shape in the front and rear direction, while the one side in the tape width direction corresponding to the tip-end side of the drawing prevention portion can be further linearly shaped.

In this case, a length in the tape width direction of the drawing prevention portion is preferably shorter than a length of the platen roller.

In this case, the first wall portion preferably has an exposed area in which the plurality of detection convex portions is exposed one after another as the tape-shaped member is paid out by the platen roller, and a rotation shaft of the platen roller is preferably pivotally supported by platen engagement holes of the first wall portion and the second wall portion.

According to the configuration, the exposed area is provided in the cartridge case. Therefore, the detection convex portions can be exposed in the exposed area. In addition, the platen roller can be pivotally supported by the first wall portion and the second wall portion.

In this case, the platen engagement hole of the first wall portion is preferably provided in the exposed area.

According to the configuration, the platen engagement holes are provided in the exposed area. Therefore, the respective detection convex portions can appropriately enter the area between the light-emission element and the light-reception element of the light sensor.

According to the present invention, there is provided a tape printing apparatus comprising: the above tape cartridge; a cartridge installation portion in which the tape cartridge is installed; a print head that performs printing on a tape-shaped member; and a feed portion that rotates and drives a platen roller.

According to the configuration, printing can be appropriately performed on a print tape with the tape cartridge that prevents the print tape from becoming wrinkled while preventing the tip end of the tape-shaped member from getting in a cartridge case.

In this case, the tape-shaped member preferably has a plurality of detection target portions provided along a tape length direction at an end on the one side in a tape width direction, and the tape printing apparatus preferably further includes a detection portion that is positioned between the drawing prevention portion and the platen roller in a tape feed direction and detects passage of the respective detection target portions.

According to the configuration, on a feed path from the drawing prevention portion to the platen roller, the one side in the tape width direction of the tape-shaped member having the detection target portions is fed in a state of being formed into a linear shape. Therefore, compared with a case in which the one side is curved like an "S"-shape, the respective detection target portions can appropriately enter the detection portion positioned between the drawing prevention portion and the platen roller without changing their entering path for each time. Accordingly, the detection portion can appropriately detect the passage of the detection target portions.

Note that the "area between the drawing prevention portion and the platen roller in the tape feed direction" is a concept including a position aligning with the drawing prevention portion or a position aligning with the platen roller in the tape feed direction.

BEST MODES FOR CARRYING OUT THE INVENTION

Hereinafter, a description will be given of a label creation apparatus according to an embodiment of the present invention with reference to the accompanying drawings. The label creation apparatus of the embodiment is used in a state of being connected to a print data creation apparatus (for example, a personal computer) in a wired or wireless fashion, acquires print data created and edited by the print data creation apparatus, and performs printing on the respective label portions of a label tape based on the acquired print data.

[Overview of Label Creation Apparatus 1]

Figure 1:
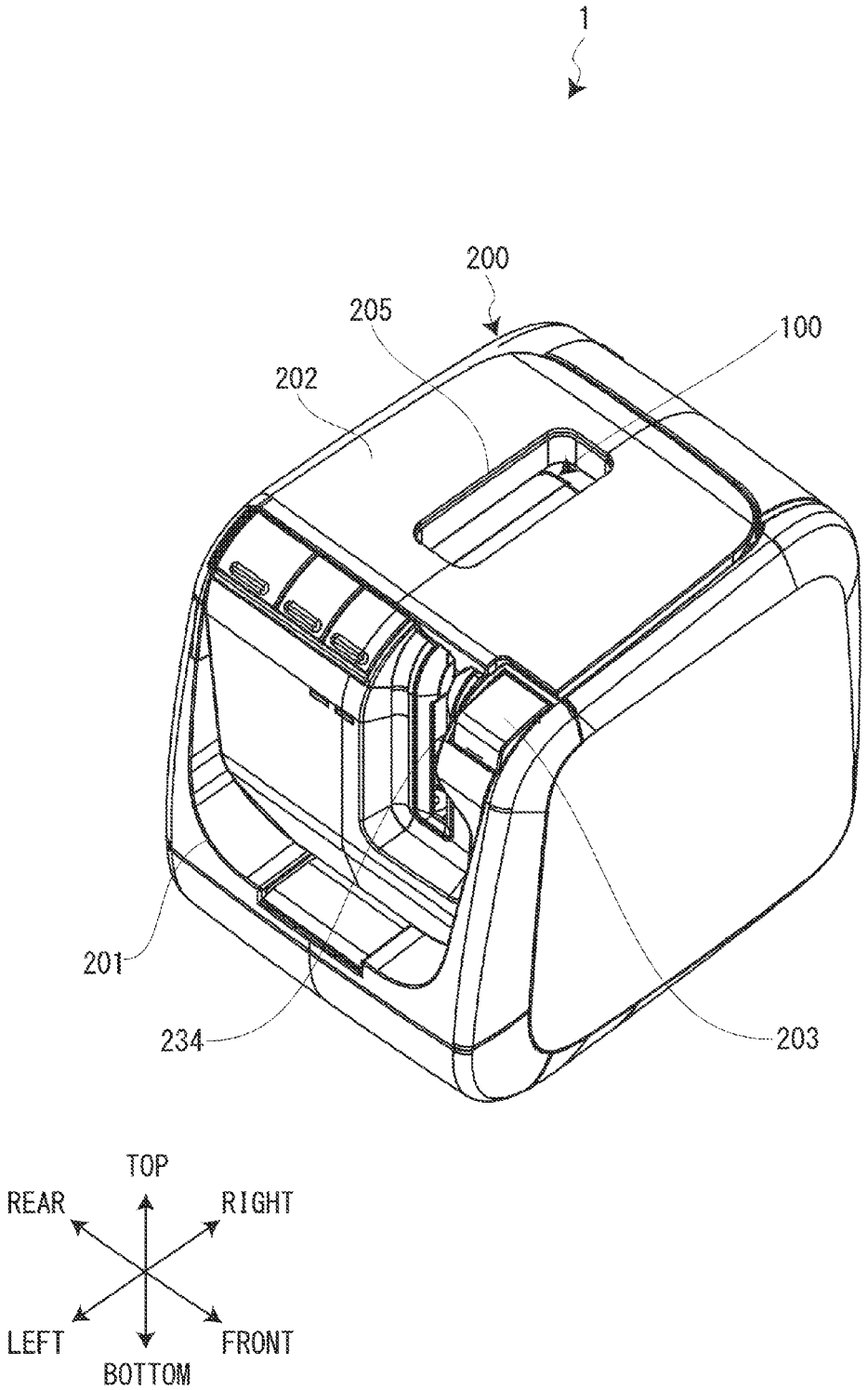
FIG. 1 is a perspective view showing a state in which the cover of a label creation apparatus according to an embodiment of the present invention is closed.
Figure 2:
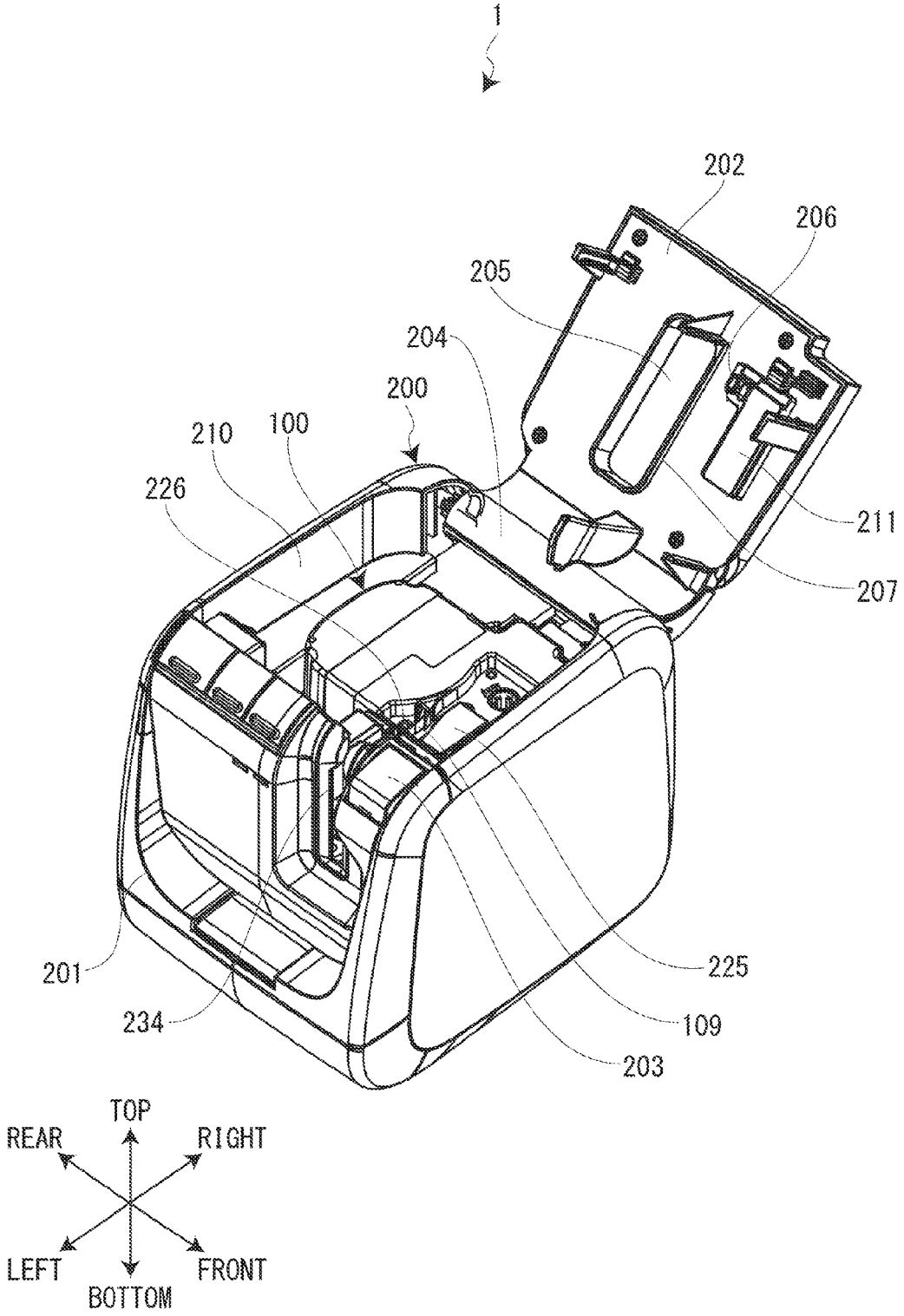
FIG. 2 is a perspective view showing a state in which the cover of the label creation apparatus according to the embodiment of the present invention is opened.
Figure 6:
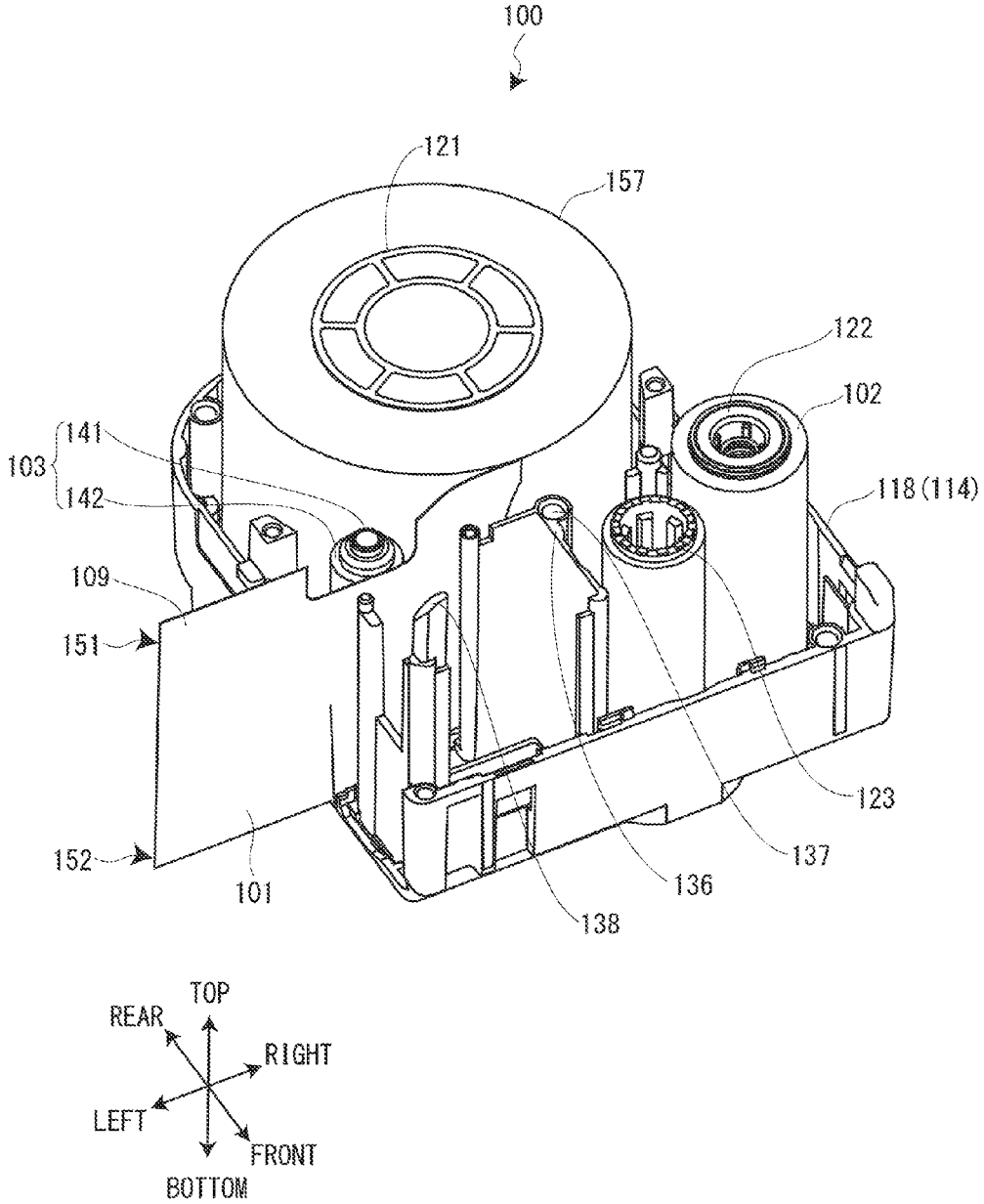
FIG. 6 is a perspective view of the tape cartridge with its upper casing removed.

As shown in FIGS. 1 and 2, a label creation apparatus 1 has a tape cartridge 100 and an apparatus main body 200 in which the tape cartridge 100 is attachably/detachably installed. The tape cartridge 100 has a label tape 101, an ink ribbon 102, a platen roller 103, and a cartridge case 104 in which the label tape 101, the ink ribbon 102, the platen roller 103 are accommodated (see FIG. 6).

Figure 3A:
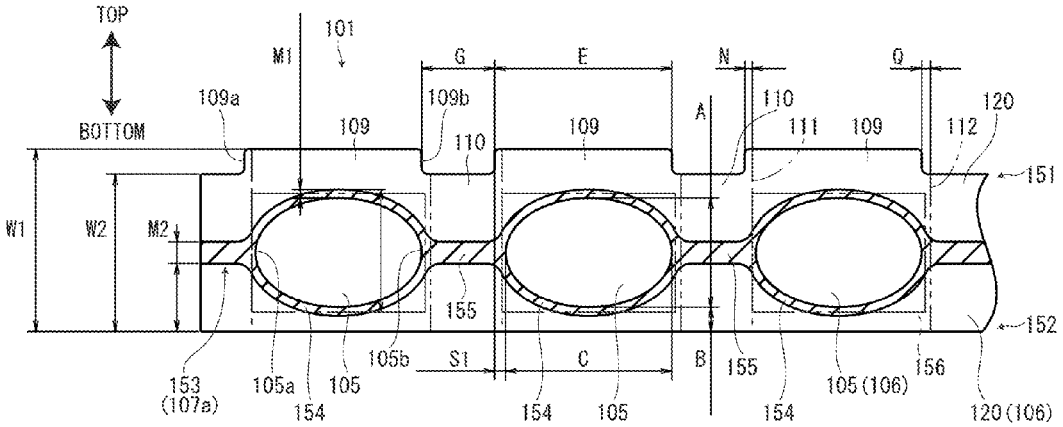
FIGS. 3A to 3C are views showing a label tape accommodated in the tape cartridge of the label creation apparatus.
Figure 3B:
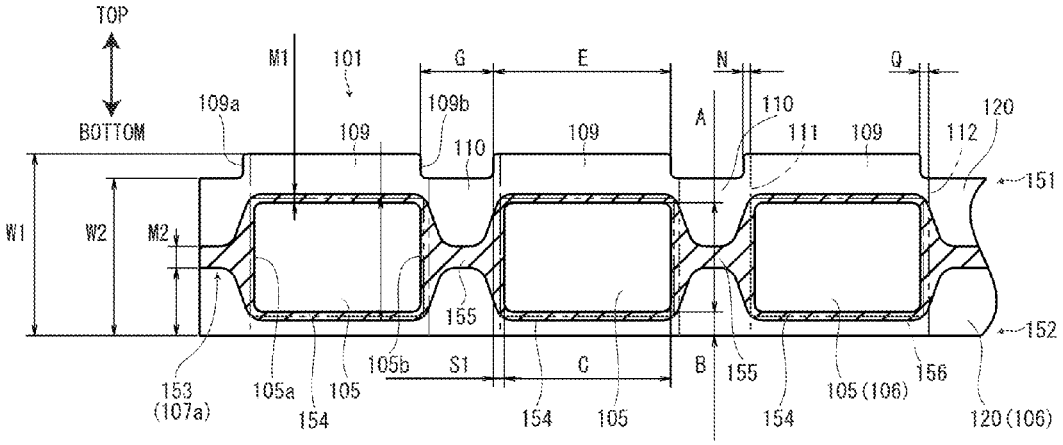
Figure 3C:
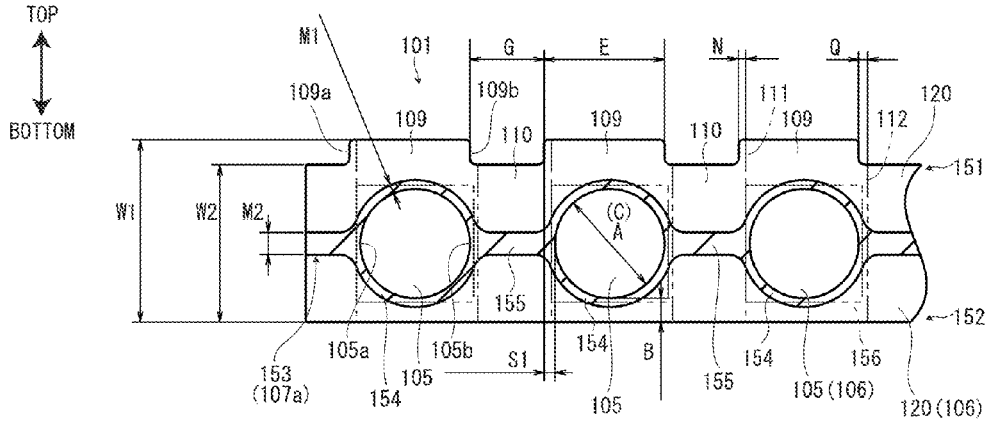
Figure 4:
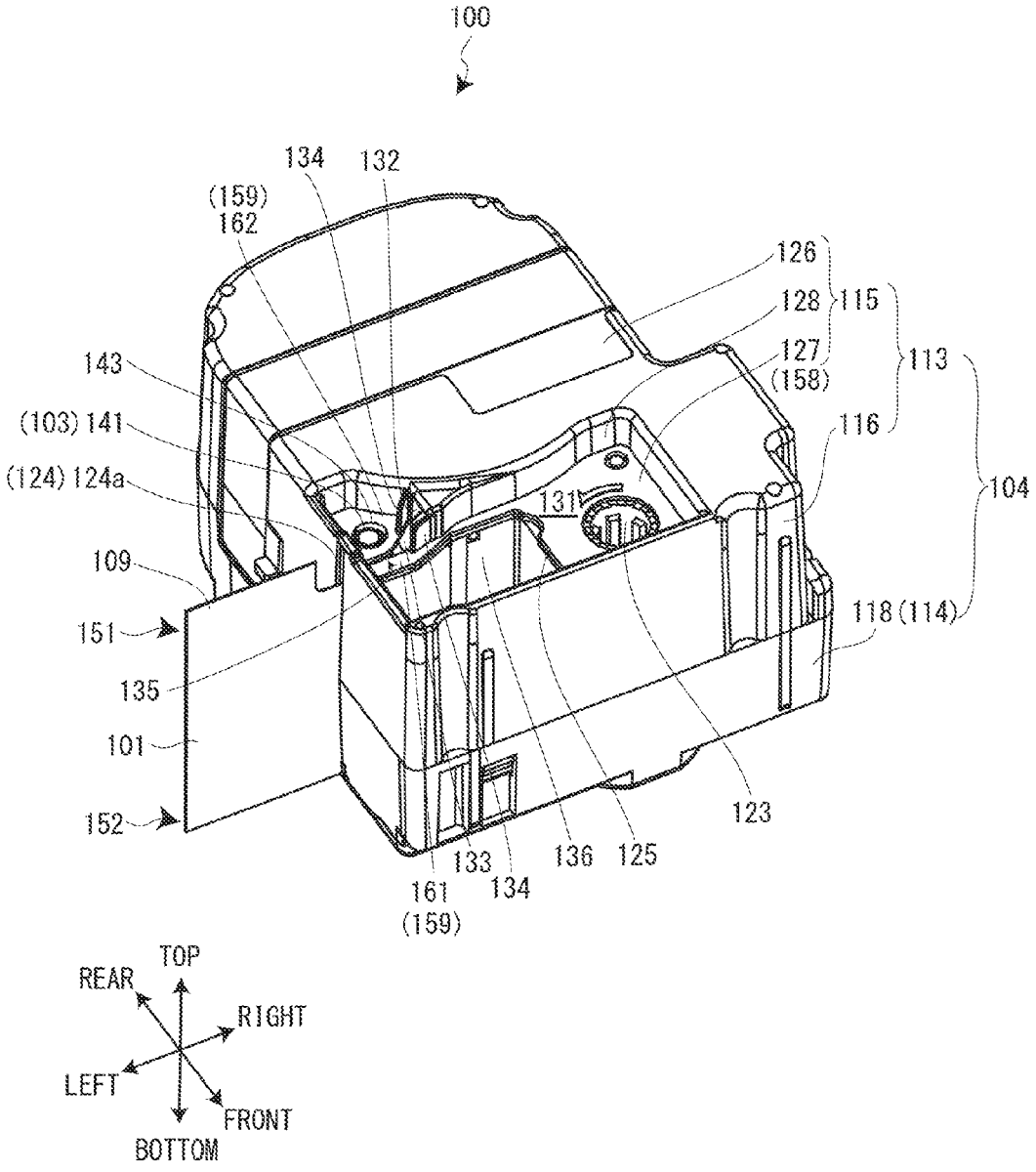
FIG. 4 is a perspective view of the tape cartridge.
Figure 5:
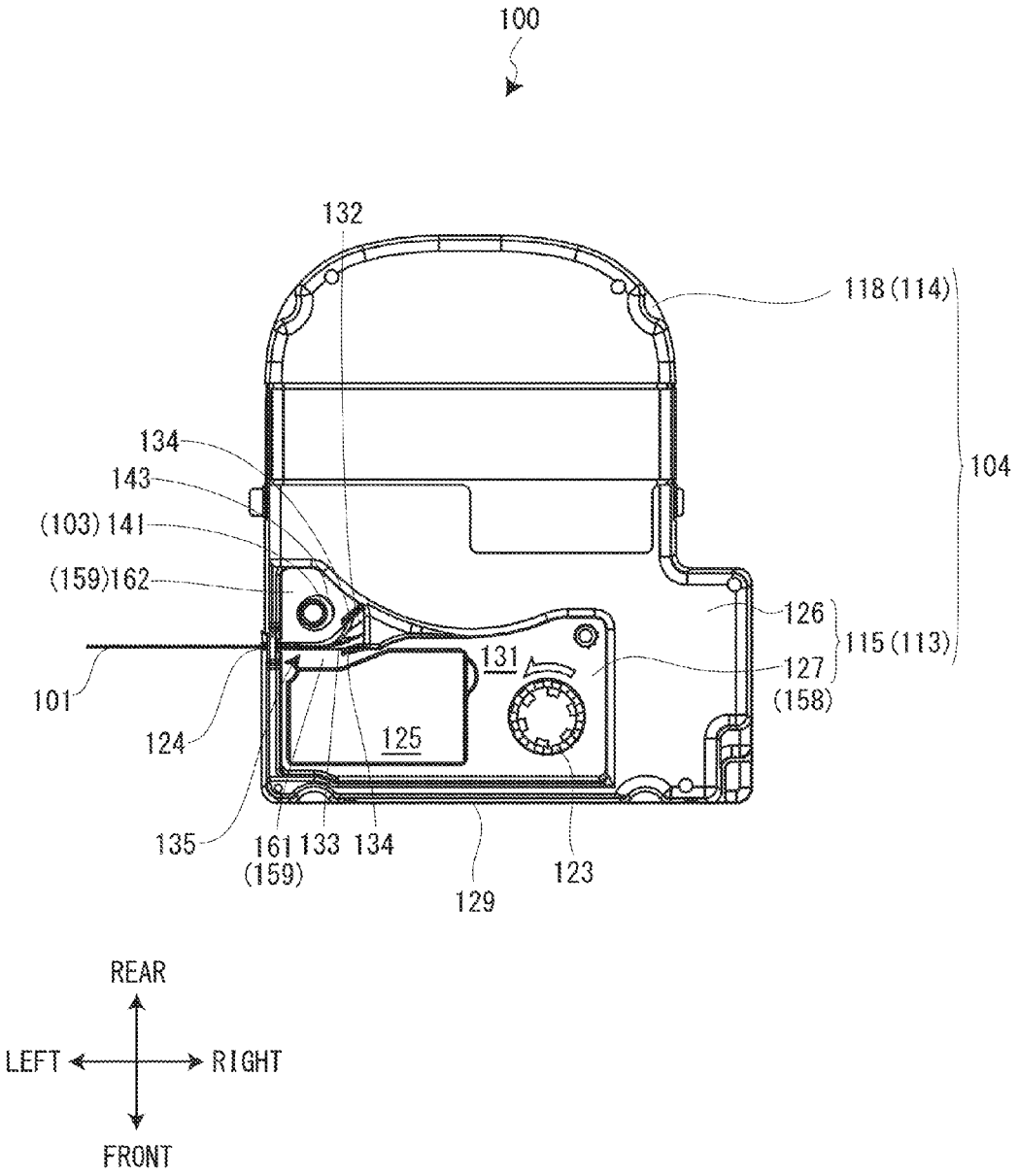
FIG. 5 is a plan view of the tape cartridge.

The label tape 101 has a plurality of label portions 105 provided along its length direction (see FIGS. 3A to 3C).

Note that the apparatus main body 200 is an example of a "tape printing apparatus" in the claims. In addition, the label tape 101 is an example of a "tape-shaped member" in the claims.

The label creation apparatus 1 performs printing on the respective label portions 105 based on print data acquired from a print data creation apparatus not shown while paying out and feeding the label tape 101 from the installed tape cartridge 100 and separates the printed respective label portions 105 to create labels printed as desired.

[Configuration of Label Tape 101]

A description will be given of the label tape 101 with reference to FIGS. 3A to 3C and FIG. 15B. Note that the width direction of the tape will also be called a "top and bottom direction" in the following description. Of course, the direction is only for illustration purpose, and the present invention is not limited to the direction for its implementation.

The label tape 101 has a backing tape 107 as a release tape, a print tape 106 releasably affixed to a backing surface 107*a* of the backing tape 107, and a backing-surface exposed portion 153 at which the backing surface 107*a* is exposed like substantially the "rim of glasses."

Note that the backing tape 107 is an example of a "release tape" in the claims.

The backing tape 107 has a plurality of backing convex portions 108 partially projecting from one end, i.e., an upper end in the width direction of the tape. On the other hand, the print tape 106 has the plurality of label portions 105 provided along its length direction and has two non-label portions 120 in the top and bottom direction.

The plurality of label portions 105 is releasably affixed to the backing surface 107*a* of the backing tape 107 excluding the plurality of backing convex portions 108. On the peripheries of the respective label portions 105, annular exposed portions 154 at which the backing surface 107*a* is exposed are provided. The above backing-surface exposed portion 153 is constituted by the plurality of annular exposed portions 154 and a plurality of connection exposed portions 155 that connects the annular exposed portions to each other. The non-label portions 120 are releasably affixed to the backing surface 107*a* of the backing tape 107. The non-label portions 120 on a top side in the figures are affixed to the backing surface 107*a* so as to cover the plurality of backing convex portions 108 and constitute a plurality of detection convex portions 109 with the plurality of backing convex portions 108.

As shown in FIGS. 3A to 3C, the label tape 101 has the plurality of label portions 105 at a substantially even pitch along its length direction. In addition, the label tape 101 has a first lateral portion 151 and a second lateral portion 152 on both lateral sides in its width direction, and the first lateral portion 151 on the top side is formed into a concavo-convex shape in the width direction. That is, the label tape 101 has the above convex detection convex portions 109 and concave non-detection concave portions 110 alternately provided in the length direction.

Note that the side of the first lateral portion 151 corresponds to "the side of one end of a tape-shaped member" and the side of the second lateral portion 152 corresponds to "the side of the other end of the tape-shaped member" in the claims.

The detection convex portions 109 are obtained by making the first lateral portion 151 partially projected to a lateral side, i.e., a top side in the width direction of the tape so as to be formed into a substantially rectangular shape. The plurality of detection convex portions 109 is provided along the length direction of the tape at the same pitch as that of the plurality of label portions 105 so as to individually correspond to the plurality of label portions 105.

In the length direction of the tape, the tape paying-out tip-end sides of the respective detection convex portions 109, i.e., detection tip-ends 109*a* serving as downstream-side ends in the paying-out direction of the label tape 101 are positioned downstream of the tape paying-out tip-end sides of the respective label portions 105, i.e., label tip-ends 105*a* serving as downstream-side ends in the paying-out direction of the label tape.

On the other hand, in the length direction of the tape, paying-out terminal-end sides of the respective detection convex portions 109, i.e., detection rear-ends 109*b* serving as upstream-side ends in the paying-out direction are arranged at the same positions as those of the paying-out terminal-end sides of the respective label portions 105, i.e., label rear-ends 105*b* serving as upstream-side ends in the paying-out direction.

The label tape 101 is constituted by the backing tape 107 and the print tape 106 releasably affixed to one of the front and rear surfaces of the backing tape 107, i.e., the backing surface 107*a* (see FIGS. 15A and 15B) via an adhesive. The backing surface 107*a* is, for example, siliconized to make the print tape 106 easily released. The materials of the backing tape 107 and the print tape 106 are not particularly limited, and a paper, a resin, or the like can, for example, be used as such. The print tape 106 is lower in translucency than the backing tape 107. In other words, the print tape 106 is higher in light-shielding performance than the backing tape 107.

As described above, the backing-surface exposed portion 153 has the plurality of annular exposed portions 154 provided along the length direction of the tape and the plurality of connection exposed portions 155 that connects the annular exposed portions 154 to each other. The plurality of annular exposed portions 154 is provided so as to leave margins on both the lateral sides in the width direction of the tape.

The print tape 106 provided inside the respective annular exposed portions 154 serves as the above label portions 105. In addition, the print tape 106 provided on both the lateral sides of the plurality of annular exposed portions 154 in the width direction serves as the non-label portions 120. That is, the print tape 106 has the plurality of label portions 105 and the two non-label portions 120.

The shape of the respective label portions 105 is not particularly limited, and the respective label portions 105 may have various shapes such as an elliptic shape (see FIG. 3A), a corner-round rectangular shape (see FIG. 3B), and circular shape (see FIG. 3C). In addition, the elliptic shape includes a circular shape having a long axis.

The non-label portions 120 are provided on both the sides of the first lateral portion 151 and the second lateral portion 152 of the label tape 101. In addition, the respective non-label portions 120 are continuously provided in the length direction of the tape.

The backing-surface exposed portion 153 is formed in such a way that die-cutting is performed to cut out the print tape 106 into the shape of the backing-surface exposed portion 153 and the die-cut portions of the print tape 106 are removed from the backing tape 107, i.e., unnecessary portions are removed. Note that since the annular exposed portions 154 are connected to each other by the connection exposed portions 155, the unnecessary portions can be removed from the print tape 106 one after another.

Although the sizes of the respective portions of the label tape 101 configured as described above are not particularly limited, examples thereof will be shown below.

The tape width of the label tape 101 including the detection convex portions 109 (hereinafter also called a first tape width W1): 42 mm The tape width of the label tape 101 excluding the detection convex portions 109 (hereinafter also called a "second tape width W2"): 36 mm The distance between the detection tip-end 109*a* and the label tip-end 105*a* when a distance to the upstream side in the paying-out direction is positive in the length direction of the tape (hereinafter also called a "first distance S1"): 2.5 mm The size A of the label portion 105 in the width direction of the tape: 25 mm The size B between the lower end of the label portion 105 and the lower end of the label tape 101: 5.5 mm The size G of the non-detection concave portion 110 in the length direction of the tape: 16.7 mm The exposed width M1 of the annular exposed portion 154: 2 mm The exposed width M2 of the connection exposed portion 155: 5 mm Note that the size C of the label portion 105 in the length direction of the tape is different depending on the shape of the label portion 105. Accordingly, the size E of the detection convex portion 109 in the length direction of the tape is different depending on the shape of the label portion 105.

The label creation apparatus 1 can perform rimless printing on the respective label portions 105, i.e., it can perform printing so as not to leave margins on the peripheries of the label portions 105 (see FIGS. 12A to 12E). Therefore, ranges protruding to both sides in the length direction and both sides in the width direction of the tape by a prescribed size, for example, 1 mm from the respective label portions 105 are print ranges 156.

In addition, as will be described in later, the apparatus main body 200 controls the feeding of the label tape 101 based on whether the respective detection convex portions 109, i.e., the detection tip-ends 109*a* and the detection rear-ends 109*b* have passed. After having detected the passage of the detection tip-ends 109*a*, the apparatus main body 200 feeds the label tape 101 by a print margin width N and then starts printing on the respective label portions 105. In addition, after having detected the passage of the detection rear-ends 109*b*, the apparatus main body 200 feeds the label tape 101 by a cut margin width Q and then cuts off the label tape 101. That is, the label tape 101 has print start spots 111 at positions upstream of the detection tip-ends 109*a* by the print margin width N in the paying-out direction and has cut spots 112 upstream of the detection rear-ends 109*b* by the cut margin width Q in the paying-out direction. The print margin width N is, for example, 1.5 mm, and the cut margin width Q is, for example, 2.5 mm. In addition, the values of the print margin width N and the cut margin width Q are adjusted at the shipment of the apparatus main body 200 or the like. Moreover, a user is also allowed to operate the print data creation apparatus to adjust the values of the print margin width N and the cut margin width Q.

Note that with the non-detection concave portions 110 provided at the positions of the detection convex portions 109 and the detection convex portions 109 provided at the positions of the non-detection concave portions 110 in the embodiment, the apparatus main body 200 may start printing on the respective label portions 105 based on whether the detection rear-ends 109 have passed and may separate the respective label portions 105 based on whether the detection tip-ends 109*a* have passed.

[Configuration of Tape Cartridge 100]

A description will be given of the tape cartridge 100 with reference to FIGS. 4 to 7. Note that in the following description, the thickness direction of the tape cartridge 100 will also be called a "top and bottom" direction, the width direction thereof will also be called a "right and left" direction, and the depth direction thereof will also be called a "front and rear" direction. Of course, these directions are for illustration purpose, and the present invention is not limited to these directions for its implementation.

As shown in FIGS. 4 to 7, the cartridge case 104 is joined such that an upper casing 113 and a lower casing 114 are abutted against each other so as to be separable. The upper casing 113 has a top wall portion 115 and an upper peripheral wall portion 116 projecting from the periphery of the top wall portion 115. The lower casing 114 has a bottom wall portion 117 and a lower peripheral wall portion 118 projecting from the periphery of the bottom wall portion 117. The top wall portion 115 and the bottom wall portion 117 face each other. Note that the upper casing 113 is made of a semi-transparent resin and the lower casing 114 is made of a light-shielding (for example, black and non-transparent) resin.

Note that the top wall portion 115 is an example of a "first wall portion" and the bottom wall portion 117 is an example of a "covering wall portion" and a "second wall portion" in the claims.

In the cartridge case 104, a tape roll 157 is accommodated on a rear side, a ribbon paying-out reel 122 and a ribbon winding-up reel 123 are accommodated on a right front side, and a platen roller 103 is accommodated at a left end.

The tape roll 157 is wound on a tape core 121 in a roll shape so as to be capable of being paid out with the side of the print tape 106 of the label tape 101 directed outward. The tape roll 157 is accommodated in the cartridge case 104 so as to make the first lateral portion 151 having the detection convex portions 109 positioned on the side of the top wall portion 115 and make the second lateral portion 152 positioned on the side of the bottom wall portion 117. That is, the end surface on the side of the first lateral portion 151 of the label tape 101 is covered with the top wall portion 115 of the upper casing 113, and the end surface on the side of the second lateral portion 152 of the label tape 101 is covered with the bottom wall portion 117 of the lower casing 114.

On the other hand, the ink ribbon 102 is wound on the ribbon paying-out reel 122 so as to be capable of being paid out, and the ink ribbon 102 paid out from the ribbon paying-out reel 122 is wound up by the ribbon winding-up reel 123.

On the left side surface of the cartridge case 104, i.e., on the left side surfaces of the upper peripheral wall portion 116 and the lower peripheral wall portion 118, a slit-shaped tape delivery port 124 that is long in the top and bottom direction is formed to eject the label tape 101 to the outside of the cartridge case 104. In addition, at the left front corner portion of the cartridge case 104, a head opening 125 allowing the insertion of a print head 225 that will be describe later is formed so as to penetrate in the top and bottom direction.

The top wall portion 115 of the upper casing 113 is constituted by a high wall portion 126 formed in a region in which the tape roll 157 and the ribbon paying-out reel 122 are positioned in a plan view, a low wall portion 127 formed so as to be lower than the high wall portion 126 i.e., formed so as to be closer to the bottom wall portion 117 in a region in which the ribbon winding-up reel 123 and the platen roller 103 are positioned, and a vertical wall portion 128 that extends like a substantially lying "σ"-shape and connects the high wall portion 126 and the low wall portion 127 to each other.

Moreover, the upper casing 113 has substantially "L"-shaped projection wall portions 129, which project at substantially the same height as the vertical wall portion 128 so as to extend upward from the upper peripheral wall portion 116, at the front edge portion and the left edge portion of the low wall portion 127. On the upper surface of the upper casing 113, concave space 131 having a substantially rectangular shape in a plan view is formed by the low wall portion 127, the vertical wall portion 128, and the projection wall portion 129.

Figure 11:
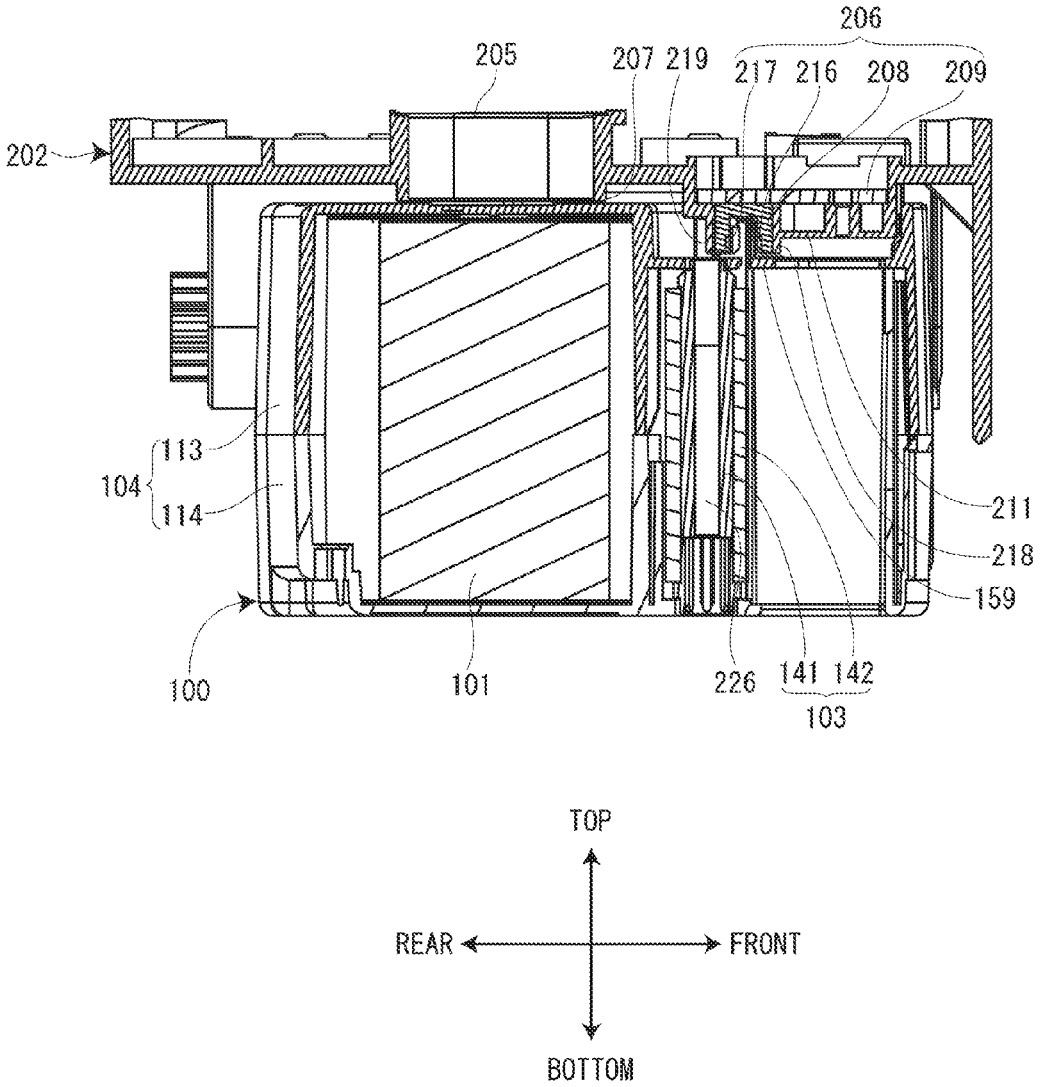
FIG. 11 is a vertical cross-sectional view of the label creation apparatus in the vicinity of the light sensor.

The low wall portion 127 has a reel wall portion 158 at which the ribbon winding-up reel 123 is provided and a roller wall portion 159 at which the platen roller 103 is provided. The upper regions of the reel wall portion 158 and the head opening 125 are surrounded by the upper ends of the upper peripheral wall portion 116 and the vertical wall portion 128 on their peripheries (in four directions) and formed into concave space 131 having a substantially rectangular shape in a plan view. The roller wall portion 159 connects a substantially middle portion in the front and rear direction on the left side of the upper peripheral wall portion 116 and the left end of the vertical wall portion 128 to each other. In addition, the roller wall portion 159 faces a light sensor 206 at a position lower than the light sensor 206 that will be described later (see FIG. 11). Since the roller wall portion 159 connects the upper peripheral wall portion 116 and the vertical wall portion 128 to each other, the strength between the upper peripheral wall portion 116 and the vertical wall portion 128 can be enhanced.

The tape cartridge 100 has a thickness corresponding to the first tape width W1 in a region in which the high wall portion 126 is formed. Note that a remaining amount of the label tape 101 wound on the tape core 121 can be visually checked via the semi-transparent high wall portion 126.

On the other hand, the tape cartridge 100 has a thickness corresponding to the second tape width W2 in a region in which the low wall portion 127 is formed. Therefore, the roller wall portion 159 of the low wall portion 127 has a slit-shaped exposed opening 133 to make the plurality of detection convex portions 109 exposed upward one after another as the label tape 101 is paid out. The roller wall portion 159 has a print-tape-side wall portion 161 on the side of the print tape 106 of the label tape 101 and a backing-tape-side wall portion 162 on the side of the backing tape 107 across the exposed opening 133.

Since the roller wall portion 159 has the exposed opening 133, the roller wall portion 159, i.e., the print-tape-side wall portion 161 and the backing-tape-side wall portion 162 can be provided on both front and rear surface sides of the label tape 101. Therefore, compared with a case in which the roller wall portion 159 is provided on only one of the front and rear sides of the label tape 101, the area of the roller wall portion 159 is increased, whereby the strength between the upper peripheral wall portion 116 and the vertical wall portion 128 can be further enhanced.

The vertical wall portion 128 has a passage port 132 through which the plurality of detection convex portions 109 passes one after another as the label tape 101 is paid out. The exposed opening 133 of the roller wall portion 159 connects the passage port 132 and the tape delivery port 124 to each other. The exposed opening 133 is formed to be wider on the side of the passage port 132, i.e., on the upstream side in the paying-out direction so as to correspond to a remaining amount of the label tape 101, i.e., a change in a feed path corresponding to a winding amount of the label tape 101 on the tape core 121.

Moreover, a pair of front and rear tape cover portions 134 is formed at an end on an upstream side in the paying-out direction of the exposed opening 133 so as to extend in a rib shape from the edge portion of the passage port 132 to a downstream side in the paying-out direction. That is, the pair of tape cover portions 134 projects upward from the edge portion of the print-tape-side wall portion 161 and the edge portion of the backing-tape-side wall portion 162 at the end on the upstream side in the paying-out direction of the exposed opening 133. The pair of tape cover portions 134 is slightly lower than the vertical wall portion 128. Therefore, the upper ends of the pair of tape cover portions 134 are positioned to be lower than the upper end of the high wall portion 126.

At a downstream end in the paying-out direction of the tape cover portions 134 in the exposed opening 133, i.e., on a side upstream of a cover-portion downstream end 134*a* (see FIG. 12A), the respective detection convex portions 109 projecting upward from the exposed opening 133 are covered with the pair of tape cover portions 134 on the side of the print tape 106 and the side of the backing tape 107. On the other hand, on a side downstream of the cover-portion downstream end 134*a* in the exposed opening 133, the respective detection convex portions 109 projecting upward from the exposed opening 133 are exposed so as to be capable of being detected by the light sensor 206 when passing through the light sensor 206. That is, the area between the cover-portion downstream end 134*a* and the tape delivery port 124 serves as an exposed area 135 at which the respective detection convex portions 109 are exposed upward to allow the passage of the respective detection convex portions 109 to be detected by the light sensor 206. The exposed area 135 is provided at a position overlapping with the platen roller 103 in the paying-out direction. The above passage port 132 is provided on an upstream side in the paying-out direction of the exposed area 135, and the above tape delivery port 124 is provided on a downstream side in the paying-out direction thereof.

Note that as will be described in detail later, the upper ends of the respective detection convex portions 109, i.e., convex lateral ends 109*c* serving as lateral ends in the width direction of the tape of the detection convex portions 109 are positioned to be higher than the roller wall portion 159 in the tape cartridge 100. In addition, the upper ends of the respective non-detection concave portions 110, i.e., non-detection lateral ends 110*c* serving as lateral ends in the width direction of the tape of the non-detection concave portions 110 are positioned to be lower than the roller wall portion 159 (see FIG. 13A).

On the other hand, a guide wall 136 projects from the bottom wall portion 117 of the lower casing 114 so as to surround the periphery (four directions) of the head opening 125 except for a portion at which the platen roller 103 faces the print head 225. At the plurality of the places of the upper end surface of the guide wall 136, guide engagement holes 137 with which the engagement pins (not shown) of the upper casing 113 engage are formed. The ink ribbon 102 paid out from the ribbon paying-out reel 122 goes around the outer peripheral surface of the guide wall 136 and is then wound up by the ribbon winding-up reel 123. Note that the ink ribbon 102 has substantially the same width as the second tape width W2.

Moreover, a slender plate-shaped drawing prevention portion 138 projects on a side upstream of the platen roller 103 in the paying-out direction so as to be positioned on the side of the print tape 106 of the label tape 101. The drawing prevention portion 138 projects from a position overlapping with the platen roller 103 in a traverse direction traversing the feed path of the label tape 101, i.e., in a direction orthogonal to the feed path (see FIG. 7). As will be described in detail later, the drawing prevention portion 138 prevents the label tape 101 from being drawn in the cartridge case 104 in cooperation with the platen roller 103.

Figure 13A:
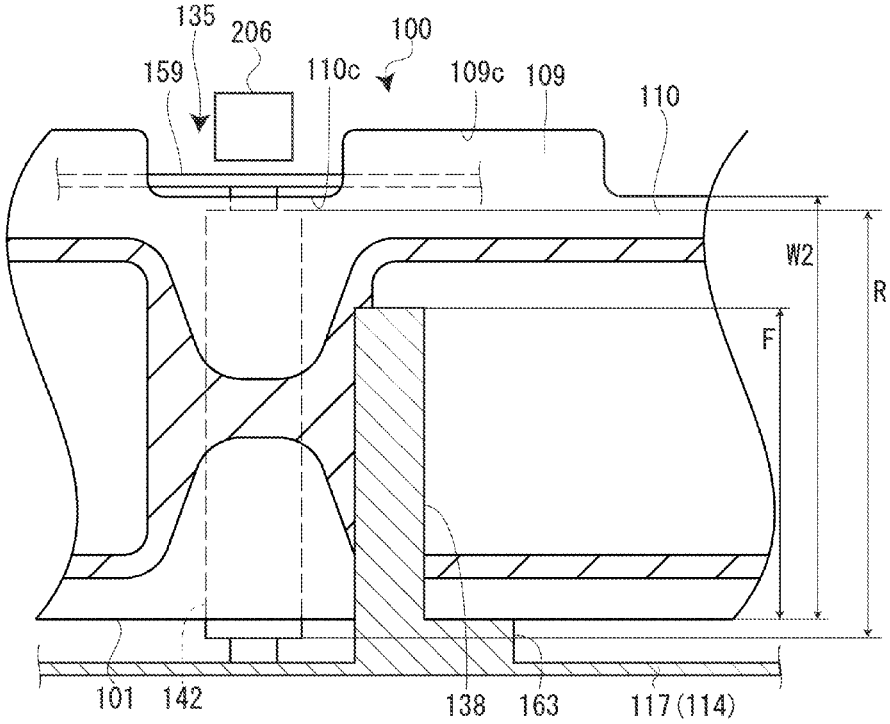
FIG. 13A is a view for describing the vicinities of a platen roller and a drawing prevention portion.
Figure 13B:
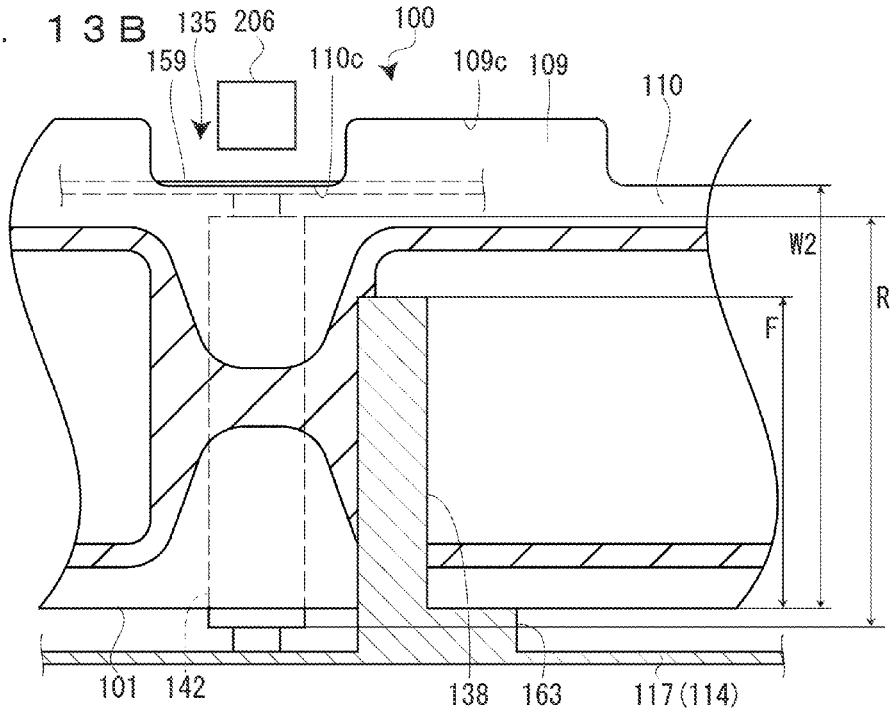
FIG. 13B is a view for describing a modified example of FIG. 13A.

A tape position restriction portion 163 projects from a base end on the upstream side in the paying-out direction of the drawing prevention portion 138 (see FIGS. 13A and 13B). When the lower end surface of the label tape 101 contacts the upper surface of the tape position restriction portion 163, the downward movement of the label tape 101 can be restricted.

The drawing prevention portion 138 does not contact the detection convex portions 109 and contacts the label tape 101 from an end on the side of the second lateral portion 152 of the label tape 101 to the midstream of the second tape width W2. A length F of the drawing prevention portion 138 is shorter than a length R of the platen roller 103 in the width direction of the tape. Here, the length F of the drawing prevention portion 138 is a length from the upper surface of the tape position restriction portion 163 to the tip end of the drawing prevention portion 138. In addition, the length R of the platen roller 103 is a length of a platen rubber 142 contacting the label tape 101. The drawing prevention portion 138 contacts an area from the lower end of the label tape 101 to a position above the second tape width W2 by a %. That is, the length F of the drawing prevention portion 138 is a % of the second tape width W2. For example, a is a value greater than equal to 50 and less than or equal to 100 and preferably a value greater than or equal to 60 and less than or equal to 80.

The tip end of the drawing prevention portion 138 does not contact the top wall portion 115 of the upper casing 113. In addition, the drawing prevention portion 138 is formed to be thin in the front and rear direction of the label tape 101, i.e., in the traverse direction traversing the feed path of the label tape 101. Therefore, the tip end of the drawing prevention portion 138 is capable of elastically tilting to a direction away from the label tape 101, i.e., to a side opposite to the platen roller 103 in the traverse direction.

The rear surface of the drawing prevention portion 138 is formed into a gentle arc shape and contacts the side of the print tape 106 of the label tape 101. On the other hand, the front surface of the drawing prevention portion 138 contacts the ink ribbon 102. That is, the print tape 106 is fed while being brought into slide-contact with the rear surface of the drawing prevention portion 138, and the ink ribbon 102 is fed while being brought into slide-contact with the front surface of the drawing prevention portion 138. The print tape 106 and the ink ribbon 102 merge with each other near the downstream side of the drawing prevention portion 138 and then is held between the platen roller 103 and the print head 225.

Here, as described above, the length (height) of the drawing prevention portion 138 is shorter (lower) than the tape width of the label tape 101 excluding the detection convex portions 109 that serves as detection target portions. Accordingly, the drawing prevention portion 138 does not contact the first lateral portion 151 of the label tape 101 that serves as one side in the width direction of the label tape 101. That is, in the width direction, the label tape 101 contacts the drawing prevention portion 138 at the second lateral portion 152 that serves as the lower side thereof, but does not contact the drawing prevention portion 138 at the first lateral portion 151 that serves as the upper side thereof. On the other hand, the front surface of the drawing prevention portion 138 contacts the ink ribbon 102.

The tape delivery port 124 is formed to be slightly longer than the first tape width W1, formed to have substantially the same width over its whole length, and formed to be slightly wider than the thickness of the label tape 101. The upper end of the tape delivery port 124 is constituted by the upper end of the upper peripheral wall portion 116 of the upper casing 113 and serves as a convex-portion passage 124*a* through which the respective detection convex portions 109 pass. Chamfering portions 139 are formed at corners on the inner surface side of the cartridge case 104 of both front and rear edges of the convex-portion passage 124*a* (see FIG. 10).

The platen roller 103 is provided so as to face the print head 225 inserted in the head opening 125, is rotated by the apparatus main body 200, and feeds by rotation the label tape 101 and the ink ribbon 102 held between the platen roller 103 and the print head 225.

The platen roller 103 has a roller main body 141 having a cylindrical shape and a platen rubber 142 wound on the roller main body 141. The platen rubber 142 is brought into rolling-contact with the side of the backing tape 107 of the label tape 101. The platen rubber 142 has substantially the same length as the second tape width W2 like the ink ribbon 102.

The backing-tape-side wall portion 162 of the upper casing 113 has an upper platen engagement hole 143 with which the upper end of the roller main body 141 engages. Similarly, the bottom wall portion 117 of the lower casing 114 has a lower platen engagement hole (not shown) with which the lower end of the roller main body 141 engages. That is, the upper platen engagement hole 143 is formed in the backing-tape-side wall portion 162 in the exposed area 135.

The upper platen engagement hole 143 and the lower platen engagement hole pivotally support the rotation shaft of the platen roller 103. In addition, each of the upper platen engagement hole 143 and the lower platen engagement hole is formed to be long in the paying-out direction. Thus, the platen roller 103 is rotatably accommodated in the cartridge case 104 and moves within a prescribed range in the paying-out direction as the label tape 101 is paid out and drawn. Therefore, even if the label tape 101 is drawn, for example, when the tape core 121 is rotated due to vibrations in a state in which the tape cartridge 100 is not installed in the apparatus main body 200, the platen roller 103 moves to the upstream side in the paying-out direction as the label tape 101 is drawn, whereby the label tape 101 is held between the platen roller 103 and the above drawing prevention portion 138. Thus, the label tape 101 is not further drawn, and the tip end of the label tape 101 is prevented from getting in the cartridge case 104.

[Configuration of Apparatus Main Body 200]

A description will be given of the apparatus main body 200 with reference to FIG. 1, FIG. 2, and FIGS. 8 to 11. Note that in the following description, the height direction of the apparatus main body 200 will also be called a "top and bottom" direction, the width direction thereof will also be called a "right and left" direction, and the depth direction thereof will also be called a "front and rear" direction. Of course, these directions are for illustration purpose, and the present invention is not limited to these directions for its implementation.

As shown in FIGS. 1 and 2, the outer shell of the apparatus main body 200 is formed by an apparatus casing 201 having a substantially cubic shape. An opening/closing cover 202 is provided at the upper surface of the apparatus casing 201. The opening/closing cover 202 opens/closes a cartridge installation portion 210 in which the tape cartridge 100 is installed. A cover opening button 203 for opening the opening/closing cover 202 is provided at the left-front corner portion of the apparatus main body 200. When the user presses the cover opening button 203, the opening/closing cover 202 rotates upward about a hinge portion 204 provided at a right end.

The tape cartridge 100 is installed in the cartridge installation portion 210 with the upper casing 113 directed upward and the lower casing 114 directed downward. Therefore, when the tape cartridge 100 is installed in the cartridge installation portion 210, the respective detection convex portions 109 exposed upward from the exposed opening 133 formed in the roller wall portion 159 of the upper casing 113 face the rear side of the closed opening/closing cover 202.

As shown in FIGS. 8 to 11, the opening/closing cover 202 has a check window 205, which is long in the right and left direction and has a rectangular shape with round corners, at a substantially central portion, and the rear side of the opening/closing cover 202 is provided with the light sensor 206 that is positioned in front of the check window 205 and detects the passage of the respective detection convex portions 109.

The check window 205 is made of a translucent resin, and the installation/uninstallation of the tape cartridge 100 in/from the cartridge installation portion 210 can be visually checked via the check window 205. Note that except for the check window 205, the apparatus casing 201 with the opening/closing cover 202 is made of a light-shielding resin. On the rear side of the opening/closing cover 202, a rib-shaped annular convex portion 207 projects from the peripheral edge portion of the check window 205. The annular convex portion 207 is also made of a light-shielding resin. The annular convex portion 207 is formed to have a height at which a slight gap is generated between the annular convex portion 207 and the upper surface of the tape cartridge 100 installed in the cartridge installation portion 210 in a state in which the opening/closing cover 202 is closed.

The light sensor 206 is constituted by a transmission-type photo interrupter and has a light-emission element 216 and a light-reception element 217 facing each other, a sensor casing 208 in which the light-emission element 216 and the light-reception element 217 are accommodated, and a sensor substrate 209 on which a circuit element is mounted. The light-emission element 216 is constituted by, for example, an infrared light-emission diode, and the light-reception element 217 is constituted by, for example, an infrared photo transistor. The sensor substrate 209 is accommodated in a substrate accommodation portion 211 slightly projecting from the rear surface of the opening/closing cover 202 in a lying "L"-shape in a bottom view.

The light sensor 206 detects the passage of the detection tip-ends 109*a* when an output voltage changes with the passage of the detection tip-ends 109*a* of the detection convex portions 109 between the light-emission element 216 and the light-reception element 217. In addition, the light sensor 206 detects the passage of the detection rear-ends 109 when the output voltage changes with the passage of the detection rear-ends 109*b* of the detection convex portions 109 between the light-emission element 216 and the light-reception element 217.

In a state in which the cover is closed, the light sensor 206 is positioned in the exposed area 135 provided at the upper surface of the cartridge case 104. In addition, when the opening/closing cover 202 is closed, the substrate accommodation portion 211 is accommodated in the concave space 131 formed in the tape cartridge 100 and prevented from interfering with the top wall portion 115 of the tape cartridge 100 (see FIG. 10).

The sensor casing 208 has a substantially reverse "U"-shape in a side view. In the sensor casing 208, a light-reception-side accommodation portion 214 in which the light-reception element 217 is accommodated and a light-emission-side accommodation portion 213 in which the light-emission element 216 is accommodated are disposed in the front and rear direction across a groove portion 212 serving as a feed path. That is, in a state in which the opening/closing cover 202 is closed, the light sensor 206 is attached to the opening/closing cover 202 with the light-emission-side accommodation portion 213 positioned on a front side and the light-reception-side accommodation portion 214 positioned on a rear side, i.e., on the side of the check window 205. That is, the light-reception element 217 turns its back to the check window 205.

Figure 10:
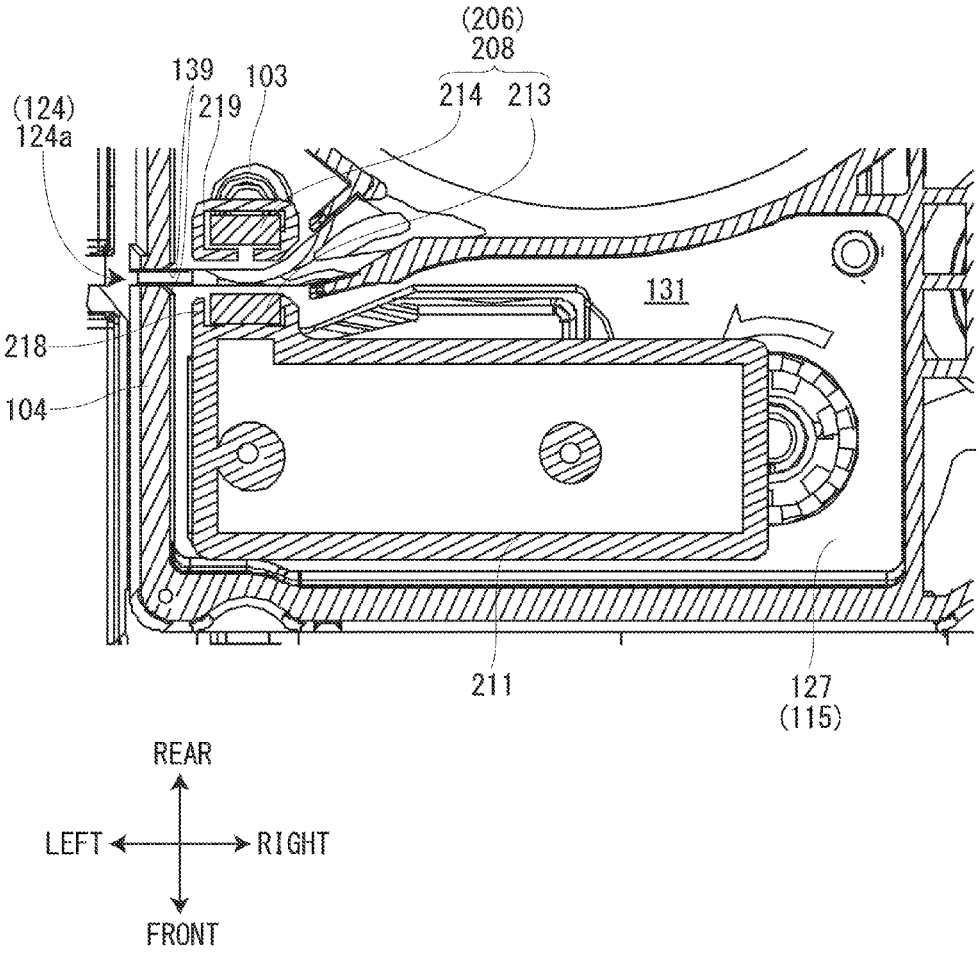
FIG. 10 is a horizontal cross-sectional view of the label creation apparatus in the vicinity of the light sensor.

Moreover, as shown in FIG. 10, the position of the light axis of detection light from the light sensor 206 aligns with the position of the shaft of the platen roller 103 in the paying-out direction. That is, a position P1 detected by the light sensor 206 aligns with a print position P2 by the print head 225 in the paying-out direction (see FIGS. 12A to 12E). Therefore, a second distance S2 between the position P1 detected by the light sensor 206 and the print position P2 by the print head 225 is 0 mm when a distance to the upstream side in the paying-out direction is positive.

The light-emission-side accommodation portion 213 and the light-reception-side accommodation portion 214, respectively, have a light-emission-side facing surface 213*a* and a light-reception-side facing surface 214*a* facing each other. The respective detection convex portions 109 pass through the area between the light-emission-side facing surface 213*a* and the light-reception-side facing surface 214, i.e., the groove portion 212. A facing distance D1 (see FIG. 9) that is the distance between the light-emission-side facing surface 213*a* and the light-reception-side facing surface 214*a*, i.e., the width of the groove portion 212 is, for example, about 4 mm. In addition, each of the light-emission-side facing surface 213*a* and the light-reception-side facing surface 214*a* has a slit to allow detection light emitted from the light-emission element 216 to pass through.

Moreover, a light-emission-side convex portion 218 having a reverse "U"-shape in a bottom view and a light-reception-side convex portion 219 having a lying "C"-shape in a bottom view project from the lower surface of the substrate accommodation portion 211. Each of the light-emission-side convex portion 218 and the light-reception-side convex portion 219 is made of a light-shielding resin. Note that the upstream-side corner portion of the light-emission-side convex portion 218 and the upstream-side corner portion of the light-reception-side convex portion 219 are chamfered to prevent the detection tip-ends 109*a* of the respective fed detection convex portions 109 from getting stuck on the corner portions.

The light-emission-side convex portion 218 covers the peripheral surface of the light-emission-side accommodation portion 213 excluding a light-emission-side facing surface 213*a*. On the other hand, the light-reception-side convex portion 219 is integrally constituted by a light-reception-side upstream guide portion 221 formed at one tip end so as to close the light-reception side of the upstream-side opening portion of the groove portion 212, a light-reception-side downstream guide portion 222 formed at the other tip end so as to close the light-reception side of the downstream-side opening portion of the groove portion 212, and a light-reception-side cover portion 223 that covers the peripheral surface of the light-reception-side accommodation portion 214 excluding a light-reception-side facing surface 214*a*.

Each of the light-reception-side upstream guide portion 221 and light-reception-side downstream guide portion 222 internally extends to the near side of the light-reception element 217 along the light-reception-side facing surface 214*a*. The respective detection convex portions 109 pass through the groove portion 212 while being guided by the front surfaces of the light-reception-side upstream guide portion 221 and the light-reception-side downstream guide portion 222 and the light-emission-side facing surface 213*a*. That is, the respective detection convex portions 109 are fed between the light-reception-side upstream guide portion 221 and the light-reception-side downstream guide portion 222 and the light-emission-side facing surface 213*a* at a guide width D2 narrower than the above facing distance D1 (see FIG. 9).

As shown in FIG. 2, the print head 225 of a thermal type projects from the left-front corner of the cartridge installation portion. The tape cartridge 100 is installed in the cartridge installation portion 210 so as to make the print head 225 inserted in the head opening 125. Moreover, a platen driving shaft 226 that faces the print head 225 and engages with and rotates the platen roller 103 inside the tape cartridge 100 is provided to stand in the cartridge installation portion 210. Note that although not shown in the figures, a guide projection that guides the installation of the tape cartridge 100 projects from the substantially central portion of the cartridge installation portion 210 and a ribbon winding-up driving shaft that engages with and rotates the ribbon winding-up reel 123 is provided to stand on the right side of the print head 225.

Moreover, a feed portion 231 that rotates the platen driving shaft 226 and the ribbon winding-up driving shaft is provided on the rear side of the cartridge installation portion 210. The feed portion 231 has a feed motor 232 serving as a power source and a feed-power transmission mechanism (not shown) constituted by a gear train or the like that divides and transmits the power of the feed motor 232 to the platen driving shaft 226 and the ribbon winding-up driving shaft (see FIG. 12A). When the feed portion 231 rotates the platen driving shaft 226 and the ribbon winding-up driving shaft, the platen roller 103 and the ribbon winding-up reel 123 rotate to feed the label tape 101 and the ink ribbon 102.

A slit-shaped tape ejection port 234 long in the top and bottom direction is formed at the left side portion of the apparatus casing 201. The tape ejection port 234 communicates with the cartridge installation portion 210, and the label tape 101 fed from the tape cartridge 100 installed in the cartridge installation portion 210 is ejected to the outside of the apparatus via the tape ejection port 234.

A cutting portion 241 that cuts off the label tape 101 is provided between the cartridge installation portion 210 and the tape ejection port 234. The cutting portion 241 has a fixed blade 242 and a movable blade 243 with the feed path of the label tape 101 held therebetween and is constituted by a cutter 244 that cuts off the label tape 101 like scissors, a cutter motor 245 that serves as the power source of the movable blade 243, a cutter power transmission mechanism (not shown) that transmits the power of the cutter motor 245 to the movable blade 243, or the like (see FIG. 12A).

In the paying-out direction, a position at which the respective blade edges (blade lines) of the fixed blade 242 and the movable blade 243 are scraped is a cut position P3 at which the label tape 101 is cut off. Further, in the paying-out direction, a distance L1 between the cut position P3 and the above cover-portion downstream end 134*a*, i.e., the upstream end of the exposed area 135 is shorter than a distance L2 (L1<L2) between the detection tip-end 109*a* of the detection convex portion 109 corresponding to the n-th label portion 105 from the downstream side in the paying-out direction and the cut spot 112 of the n−1-th label portion 105 (see FIG. 12A).

Moreover, the apparatus main body 200 has a CPU (Central Processing Unit) and a control unit 250 (see FIGS. 12A to 12E) constituted by various storage elements or the like. As will be described later, the control unit 250 drives and controls the feed motor 232 and the cutter motor 245 based on the passage detection of the detection tip-ends 109*a* and the detection rear-ends 109*b* of the various detection convex portions 109 by the light sensor 206.

[Print/Cut Operation in Label Creation Apparatus 1]

A description will be given of a print/cut operation in the label creation apparatus 1 with reference to FIGS. 12A to 12E. Note that in FIGS. 12A to 12E, the platen roller 103, the print head 225, and the movable blade 243 are shown in black at a driving time and shown in white at a non-driving time. In addition, the light sensor 206 is shown in black when the passage of the detection tip-ends 109*a* and the detection rear-ends 109*b* of the respective detection convex portions 109 is detected and shown in white when the passage is not detected.

First, it is assumed that the n−1-th label portion 105 from the downstream side in the paying-out direction is separated at the cut spot 112 in a previous print/cut operation. At this time, the tip end of the label tape 101 aligns with the cut position P3 until a print/cut operation with respect to the label tape 101 starts. In addition, the detection tip-end 109*a* of the detection convex portion 109 corresponding to the n-th label portion 105 is positioned slightly upstream (for example, 4 mm) of the detection position P1 of the light sensor 206 in the paying-out direction (see FIG. 12A).

When the user inputs a print start in this state, the control unit 250 drives the feed motor 232 and the platen roller 103 rotates to start feeding the label tape 101 and the ink ribbon 102. Then, when the detection tip end 109*a* of the detection convex portion 109 corresponding to the n-th label portion 105 reaches the detection position P1, the light sensor 206 detects the passage of the detection tip end 109*a* and outputs the detection result to the control unit 250 (see FIG. 12B).

Upon receiving the detection result showing the passage of the detection tip-end 109*a*, the control unit 250 feeds the label tape 101 by the print margin width N (see FIGS. 3A to 3C) such that the print start spot 111 of the n-th label portion 105 reaches the print position P2. Moreover, the control unit 250 drives the print head 225 to start printing with respect to the n-th label portion 105 from the print start spot 111, i.e., the downstream-side end in the paying-out direction of the print range 156 (see FIG. 12C).

Figure 12A:
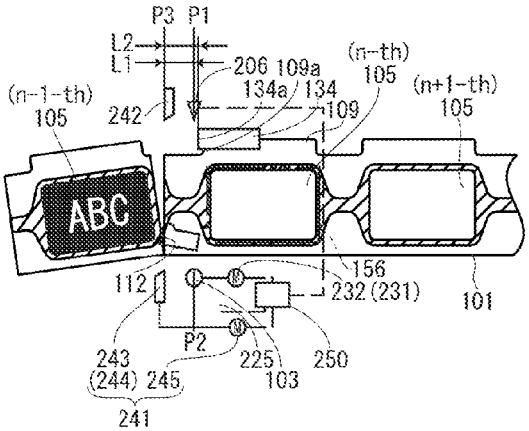
FIGS. 12A to 12E are views showing a print/cut operation in the label creation apparatus.
Figure 12D:
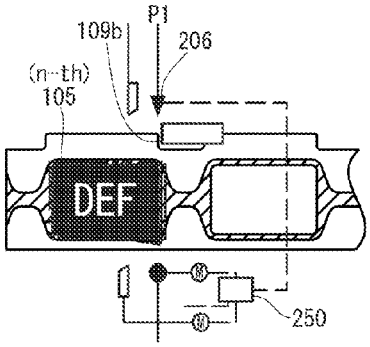
Figure 12B:
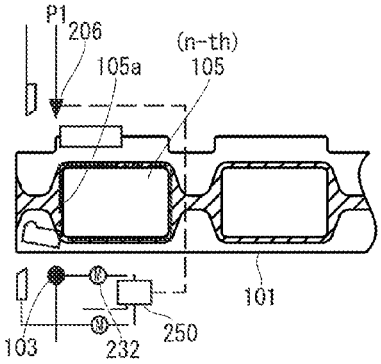
Figure 12E:
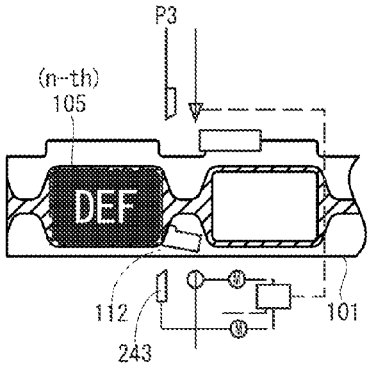
Figure 12C:
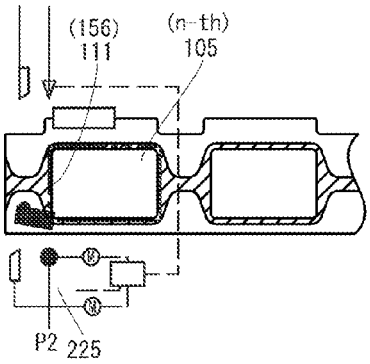

Then, when the detection rear-end 109*b* of the detection convex portion 109 corresponding to the n-th label portion 105 reaches the detection position P1, the light sensor 206 detects the passage of the detection rear-end 109*b* and outputs the detection result to the control unit 250 (see FIG. 12D).

Upon receiving the detection result of the passage of the detection rear end 109*b*, the control unit 250 feeds the label tape 101 by the cut margin width Q (see FIGS. 3A to 3C) such that the cut spot 112 of the n-th label portion 105 reaches the cut position P3. Moreover, the control unit 250 drives the movable blade 243 to cut off the label tape 101 at the cut spot 112 and separate the n-th label portion 105 (see FIG. 12E).

In the way described above, the label with a desired print can be created by the label creation apparatus 1. Note that the above description refers to a case in which one of the label portions 105 is printed and separated. However, it may also be possible to perform printing on the plurality of label portions 105 one after another and cut off the label tape 101 at the cut spot 112 of the rear most one of the label portions 105 to separate the plurality of label portions 105 in a lump.

The overview of the label creation apparatus 1 of the embodiment is described above. Next, a description will be given in further detail of (1) the positional relationship between the label tape 101 and the exposed area 135 in the tape cartridge 100, (2) the positional relationship between the detection convex portions 109 and the label portion 105 in the label tape 101, (3) the detection convex portions 109 of the label tape 101, and (4) the drawing prevention portion 138.

[(1) Positional Relationship Between Label Tape 101 and Exposed Area 135 in Tape Cartridge 100]

As shown in FIG. 13A, in the tape cartridge 100 of the embodiment, the label tape 101 is not exposed in the exposed area except for the detection convex portions 109. More specifically, the non-detection lateral ends 110*c* of the respective non-detection concave portions 110 are positioned to be lower than the roller wall portion 159. Therefore, the respective non-detection concave portions 110 are not positioned to be higher than the upper surface of the roller wall portion 159. Accordingly, the respective non-detection concave portions 110 can be prevented from being falsely detected by the light sensor 206 facing the roller wall portion 159 at a position higher than the roller wall portion 159. Therefore, the label creation apparatus 1 can perform a printing operation and a cutting operation with respect to the respective label portions 105 at an appropriate position.

As shown in FIG. 13B, the non-detection lateral ends 110*c* of the respective non-detection concave portions 110 may be at the same position as the roller wall portion 159 in the top and bottom direction. Even with this configuration, the respective non-detection concave portions 110 are not positioned to be higher than the upper surface of the roller wall portion 159. Accordingly, the respective non-detection concave portions 110 can be prevented from being falsely detected by the light sensor 206.

[(2) Positional Relationship Between Detection Convex Portions 109 and Label Portions 105 in Label Tape 101]

As described above, in the length direction of the tape, the detection tip-ends 109*a* of the detection convex portions 109 are positioned downstream of the label tip-ends 105*a* of the corresponding label portions in the paying-out direction. Further, printing starts at the print start spots 111 that are the positions between the detection tip-ends 109*a* and the label tip-ends 105*a* in the length direction of the tape. That is, the detection convex portions 109 and the label portions 105 are disposed such that printing starts at the print start spots 111 that are the positions between the detection tip-ends 109*a* and the label tip-ends 105*a* in the length direction of the tape. Thus, rimless printing is reliably performed on the respective label portions.

Figure 14A:
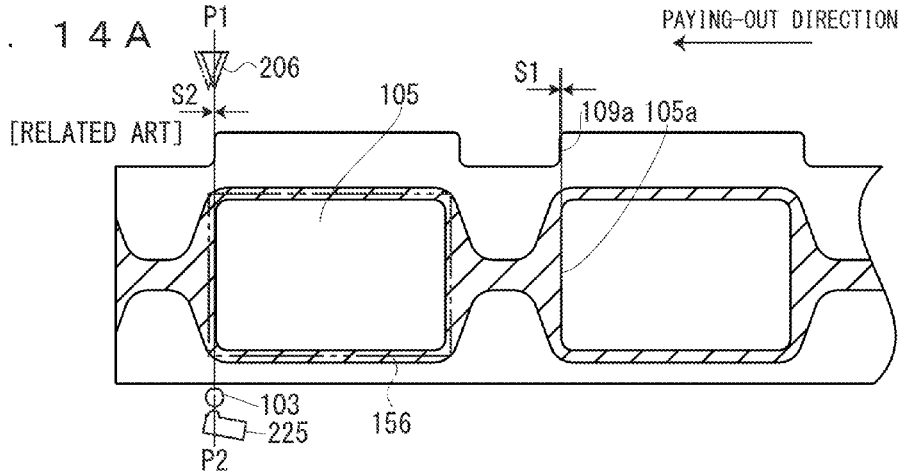
FIGS. 14A and 14C are views for describing a state in which a light sensor detects a detection tip-end in a related art.

Note that as shown in FIG. 14A, when the first distance S1 between the detection tip-end 109*a* and the label tip-end 105*a* is the same (for example, 0 mm) as the second distance S2 between the detection position P1 and the print position P2 unlike the label tape 101 of the embodiment, the label tip-end 105*a* of the corresponding label portion 105 reaches the print position P2 at a timing at which the light sensor 206 detects the detection tip-end 109*a*. Therefore, if the light sensor 206 is provided at a position slightly deviating from a setting value on the downstream side in the paying-out direction with respect to the print head 225, the label tip-end 105*a* is positioned downstream of the print position P2 in the paying-out direction at the timing at which the light sensor 206 detects the detection tip-end 109*a*. Accordingly, rimless printing cannot be reliably performed on the respective label portions 105.

Figure 14B:
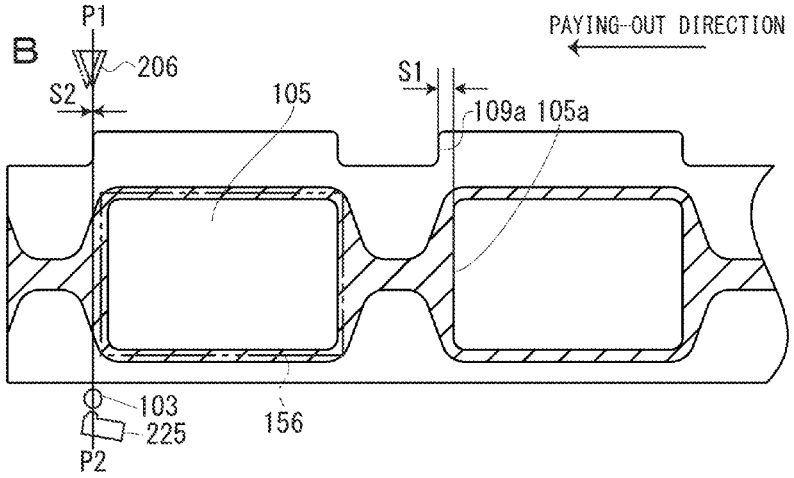
FIG. 14B is a view for describing a state in which the light sensor detects a tip end in the embodiment.
Figure 14C:
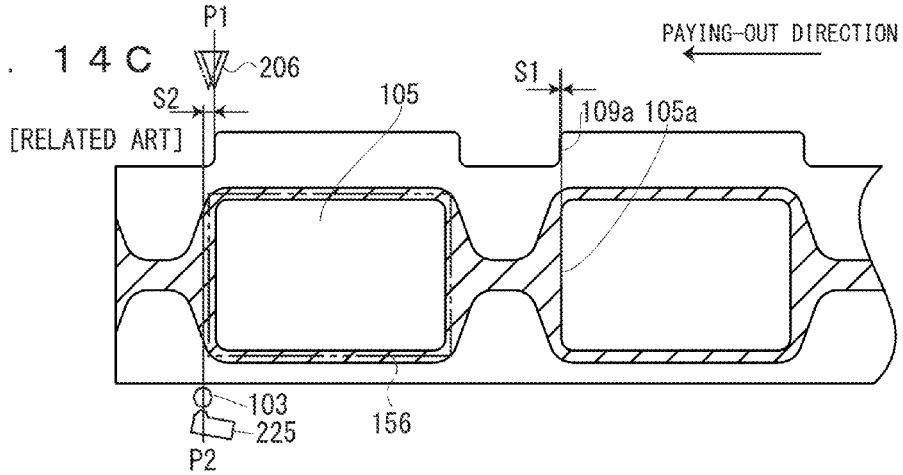

On the other hand, as shown in FIG. 14B, the label tape 101 of the embodiment is such that the first distance S1 (2.5 mm) between the detection tip-end 109*a* and the label tip-end 105*a* is greater than the second distance S2 (0 mm) between the detection position P1 and the print position P2. Therefore, at the timing at which the light sensor 206 detects the detection tip-end 109*a*, the label tip-end 105*a* of the corresponding label portion 105 is positioned upstream of the print position P2 by the difference (2.5 mm) between the first distance S1 and the second distance S2 in the paying-out direction. Accordingly, even if the light sensor 206 is provided at a position deviating from a setting value within the difference between the first distance S1 and the second distance S2 on the downstream side in the paying-out direction with respect to the print head 225, printing can start at a position deviating to downstream side of the label tip-end 105*a* in the paying-out direction with respect to the label portion 105, whereby rimless printing can be reliably performed on the respective label portions 105.

In this case, the first distance S1 may be appropriately set according to a maximum value of the positional deviation amount of the light sensor 206 with respect to the print head 225, a deviation width at rimless printing, or the like. In addition, the print margin width N is preferably adjusted according to a positional deviation amount of the light sensor 206 with respect to the print head 225 at the shipment of the apparatus main body 200, user's usage, or the like.

Note that even if the first distance is zero and the second distance S2 has a negative value, the label tip-end 105*a* of the corresponding label portion 105 is positioned upstream of the print position P2 in the paying-out direction at the timing at which the light sensor 206 detects the detection tip-end 109*a*. Therefore, the same effects as those of the embodiment can be obtained.

[(3) Detection Convex Portions 109 of Label Tape 101]

In the label tape 101, the detection convex portions 109 are constituted by the backing convex portion 108 and the non-label portions 120 affixed to the backing convex portion 108 as described above. Therefore, compared with a case in which the detection convex portions 109 are constituted only by the backing convex portion 108, the strength of the detection convex portions 109 can be further enhanced. Thus, the detection convex portions 109 are prevented from being folded. Accordingly, the detection convex portions 109 can be prevented from getting stuck on the passage port 132 and the tape delivery port 124 formed in the cartridge case 104 and the groove portion 212 of the light sensor 206. That is, the detection convex portions 109 can favorably pass through the passage port 132 and the tape delivery port 124 formed in the cartridge case 104 and the groove portion 212 of the light sensor 206.

Moreover, since the detection convex portions 109 are constituted by the backing convex portion 108 and the non-label portions 120, the light-shielding performance of the detection convex portions 109 can be further enhanced compared with the case in which the detection convex portions 109 are constituted only by the backing convex portion 108. Therefore, a rate at which detection light from the light sensor 206 is shielded by the detection convex portions 109, i.e., a light-shielding rate can be increased. Accordingly, the passage of the detection convex portions 109 can be reliably detected by the light sensor 206.

In addition, since the non-label portions 120 are affixed to the backing tape 107, the strength of the whole label tape 101 can be further enhanced compared with a case in which only the plurality of label portions 105 is affixed to the backing tape 107. Therefore, even if a tensional force is applied in the length direction of the tape, for example, when the label tape 101 is wound on the tape core 121, the label tape 101 can be prevented from being torn.

Figure 15A:
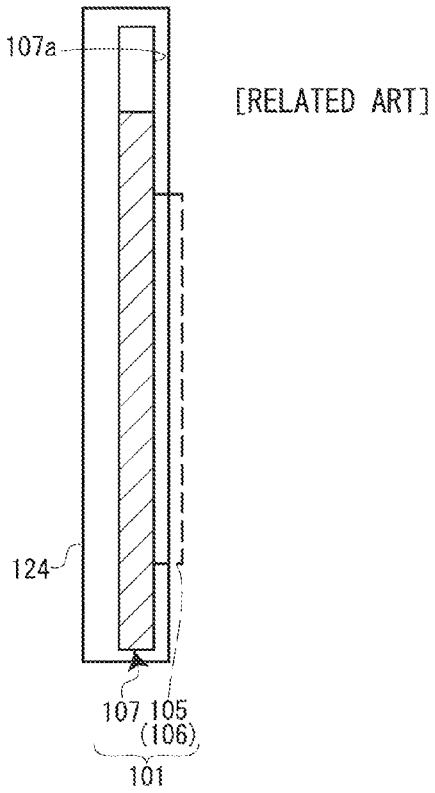
FIG. 15A is a view for describing a label tape when seen from the exit side of a tape delivery port in the related art.

Unlike the tape cartridge 100 of the embodiment, FIG. 15A shows a case in which the label tape 101, where only the plurality of label portions 105 is affixed to the backing surface 107*a* of the backing tape 107, is accommodated in the cartridge case 104. In this case, there is a likelihood that the label portion 105 overlaps with the edge portion of the tape delivery port 124 when seen from the exit side of the tape delivery port 124 at a timing at which the spots between the label portions 105 pass through the tape delivery port 124. If the label tape 101 is paid out in this state, the label tip-ends 105*a* are likely to get stuck on the edge portion of the tape delivery port 124 when the label portions 105 pass through the tape delivery port 124.

Figure 15B:
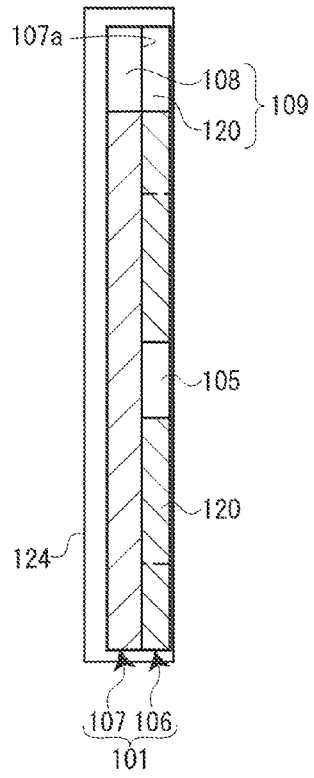
FIG. 15B is a view for describing a label tape when seen from the exit side of a tape delivery port in the embodiment.

On the other hand, as shown in FIG. 15B, the print tape 106 has the non-label portions 120 provided on both the lateral sides with respect to the plurality of annular exposed portions 154 in the width direction of the tape in the tape cartridge 100 of the embodiment. Thus, the label portions 105 are prevented from overlapping with the edge portion of the tape delivery port 124 when seen from the exit side of the tape delivery port 124 at the timing at which the spots between the label portions 105 pass through the tape delivery port 124 after the label tape 101 is paid out. Therefore, the label tip-ends 105*a* hardly get stuck on the edge portion of the tape delivery port 124 at the timing at which the respective label portions 105 pass through the tape delivery port 124. Accordingly, the label tape 101 having the plurality of label portions 105 is smoothly delivered from the tape delivery port 124.

Note that in the embodiment, the non-label portions 120 are provided on both the side of the first lateral portion 151 and the side of the second lateral portion 152 with respect to the plurality of annular exposed portions 154. However, the same effects can be obtained in a case in which the non-label portions 120 are provided on only one of the side of the first lateral portion 151 and the side of the second lateral portion 152.

Figure 16A:
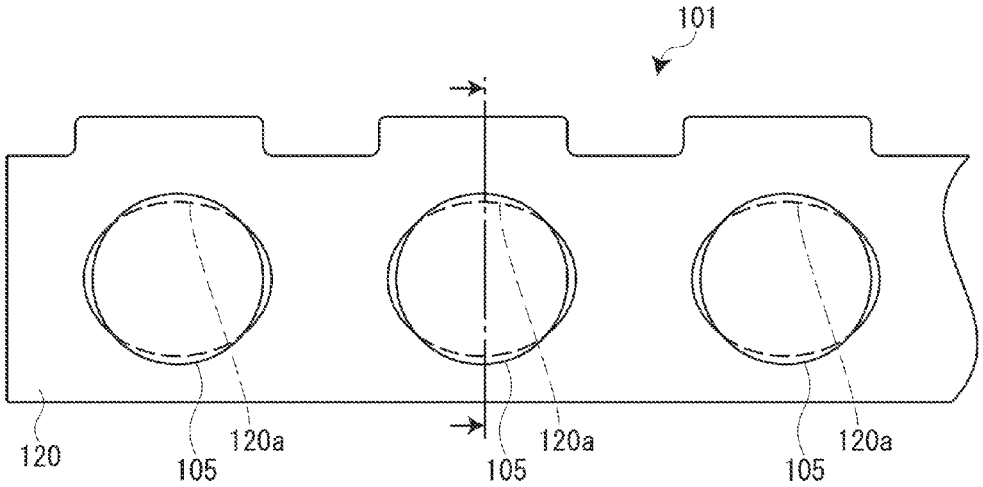
FIG. 16A is a plan view of the label tape according to the related art.
Figure 16B:
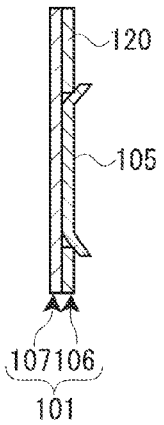
[RELATED ART] FIG. 16B
FIG. 16B is a cross-sectional view of FIG. 16A.

Note that when the print tape 106 does not have the annular exposed portions 154 and the non-label portions 120 are provided in contact with the label portions 105, the upper and lower ends of the label portions 105 may run onto the inner peripheral edge portions 120*a* of the non-label portions 120. That is, in a case in which the shape of the label portions 105 is, for example, a circle, the label portions 105 hardly deform when a tensional force in the length direction of the tape (a force to pull the tape in the length direction) is applied to wind the label tape 101 on the tape core 121. In this regard, the non-label portions 120 expand in the length direction of the tape as a whole, and the respective inner peripheral edge portions 120*a* deform from a circular shape to a substantially elliptic shape long in the length direction of the tape. Therefore, the upper and lower ends of the label portions 105 run onto the inner peripheral edge portions 120*a* (see FIGS. 16A and 16B). In this case, ink is not satisfactorily transferred to the upper and lower ends of the label portions 105 run onto the non-label portions 120, whereby rimless printing cannot be appropriately performed. On the other hand, in the label tape 101 of the embodiment, the print tape 106 has the annular exposed portions 154. Therefore, even if a tensional force in the length direction of the tape is applied, the upper and lower ends of the label portions 105 do not run onto the inner peripheral edge portions 120*a* of the non-label portions 120. As a result, rimless printing can be appropriately performed.

[(4) Drawing Prevention Portion 138]

Figure 17:
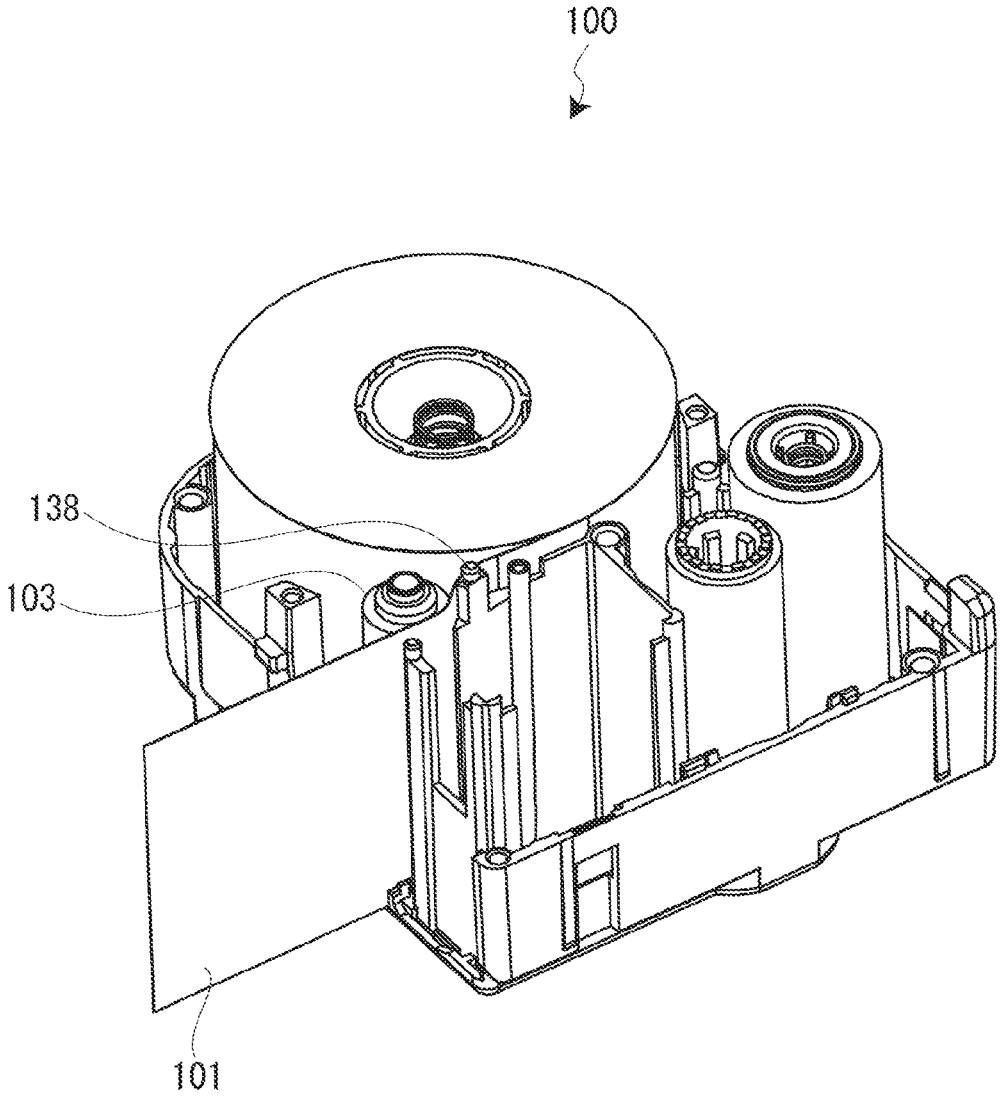
FIG. 17 is a perspective view of a tape cartridge according to the related art with its upper casing removed.
Figure 18:
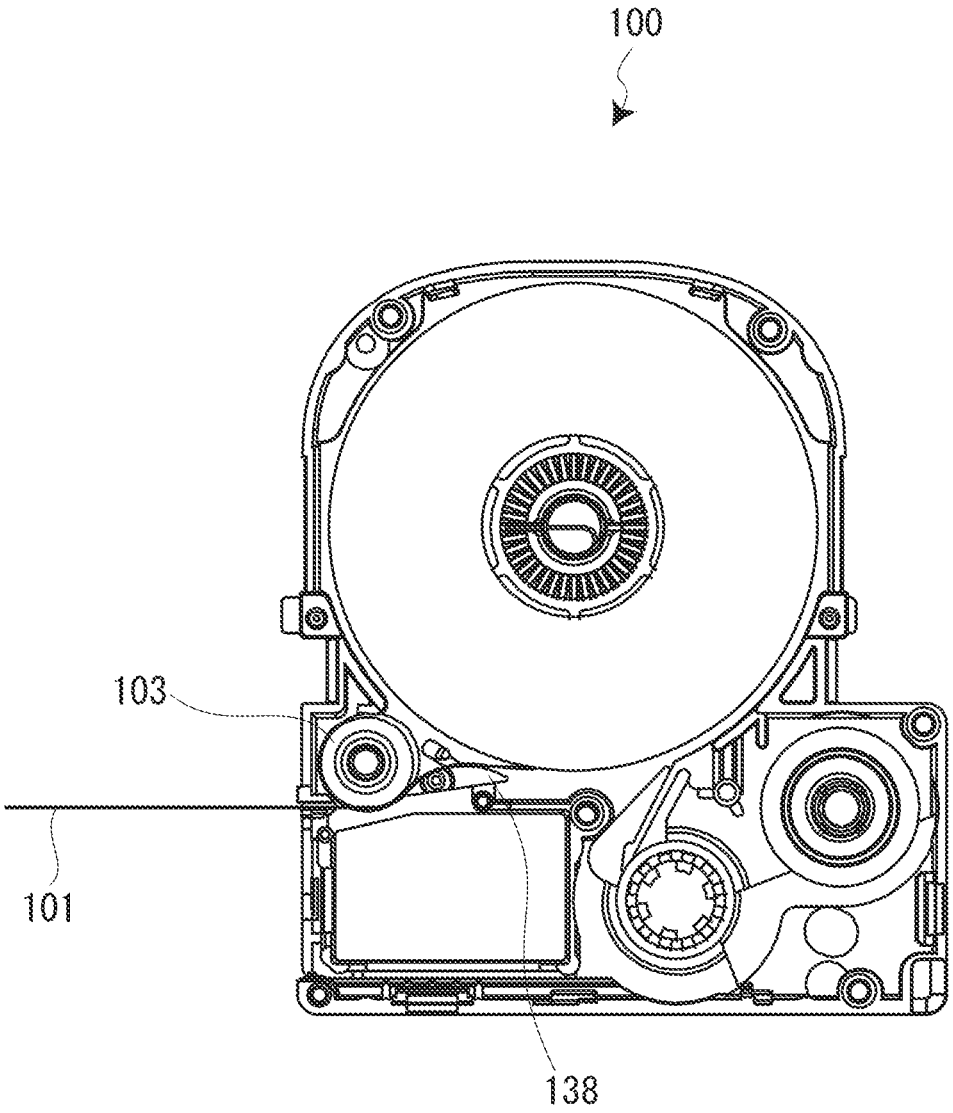
FIG. 18 is a plan view of the tape cartridge according to the related art with the upper casing removed.

As described above, the tape cartridge 100 has the platen roller 103 contacting the side of the backing tape 107 of the label tape 101 and the drawing prevention portion 138 provided upstream of the platen roller 103 in the paying-out direction and contacting the side of the print tape 106 of the label tape 101. Moreover, in a conventional tape cartridge 100 in which a normal label tape 101 without a plurality of detection convex portions 109 is accommodated, a drawing prevention portion 138 has a length engaging with a top wall portion 115 of an upper casing 113 and contacts the label tape 101 over the whole tape width (see FIG. 17). Therefore, in the conventional tape cartridge 100, the label tape 101 is curved like an "S"-shape in a front and rear direction over the whole tape width on a feed path from the drawing prevention portion 138 to a platen roller 103 (see FIG. 18).

In the tape cartridge 100 in which the label tape 101 of the embodiment is accommodated, the respective detection convex portions 109 enter the light sensor 206 in a state of being curved like an "S"-shape in the front and rear direction if the drawing prevention portion 138 contacts the respective detection convex portions 109. Therefore, compared with a case in which the respective detection convex portions 109 enter the light sensor 206 in a state of being formed into a linear shape, there is a likelihood that the respective detection convex portions 109 cannot appropriately enter the area between the light-emission element 216 and the light-reception element 217.

Figure 7:
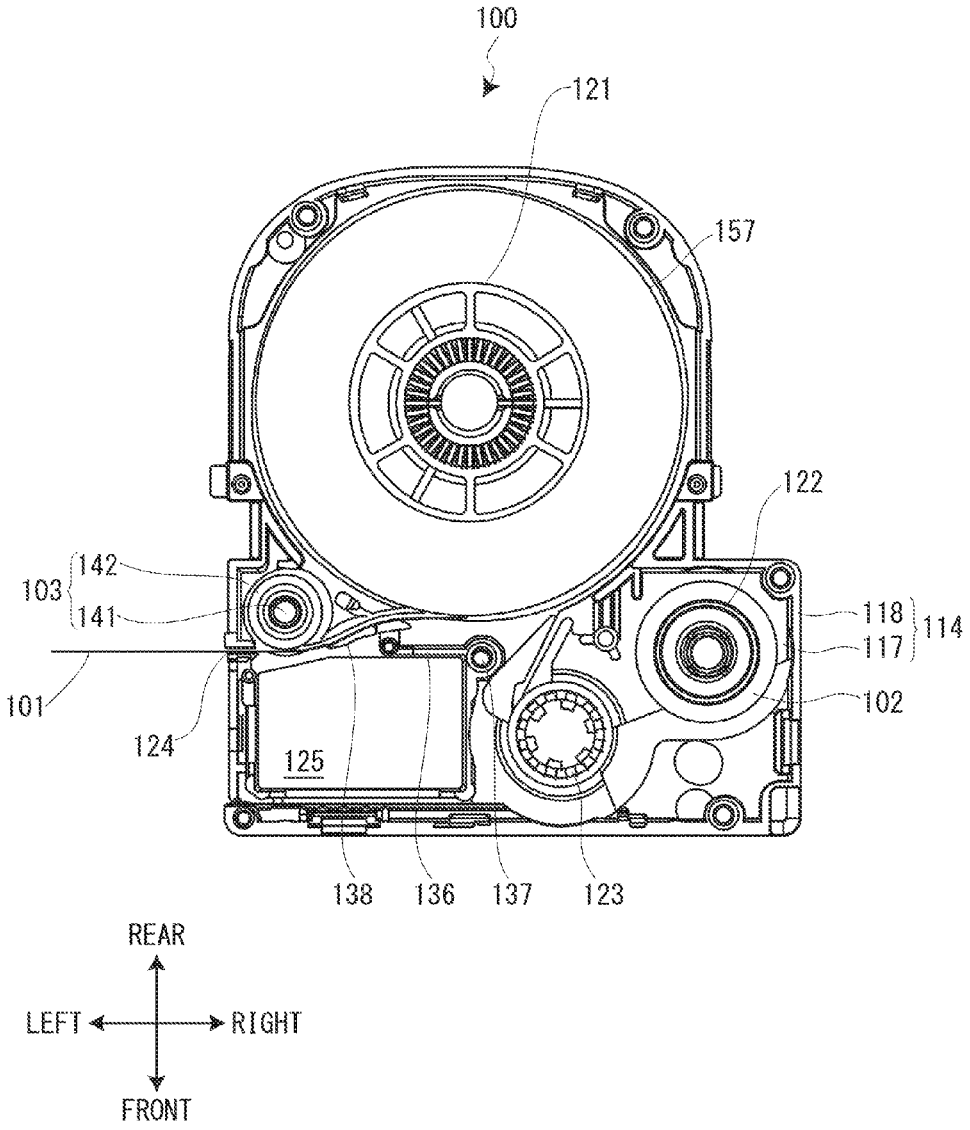
FIG. 7 is a plan view of the tape cartridge with the upper casing removed.
Figure 8:
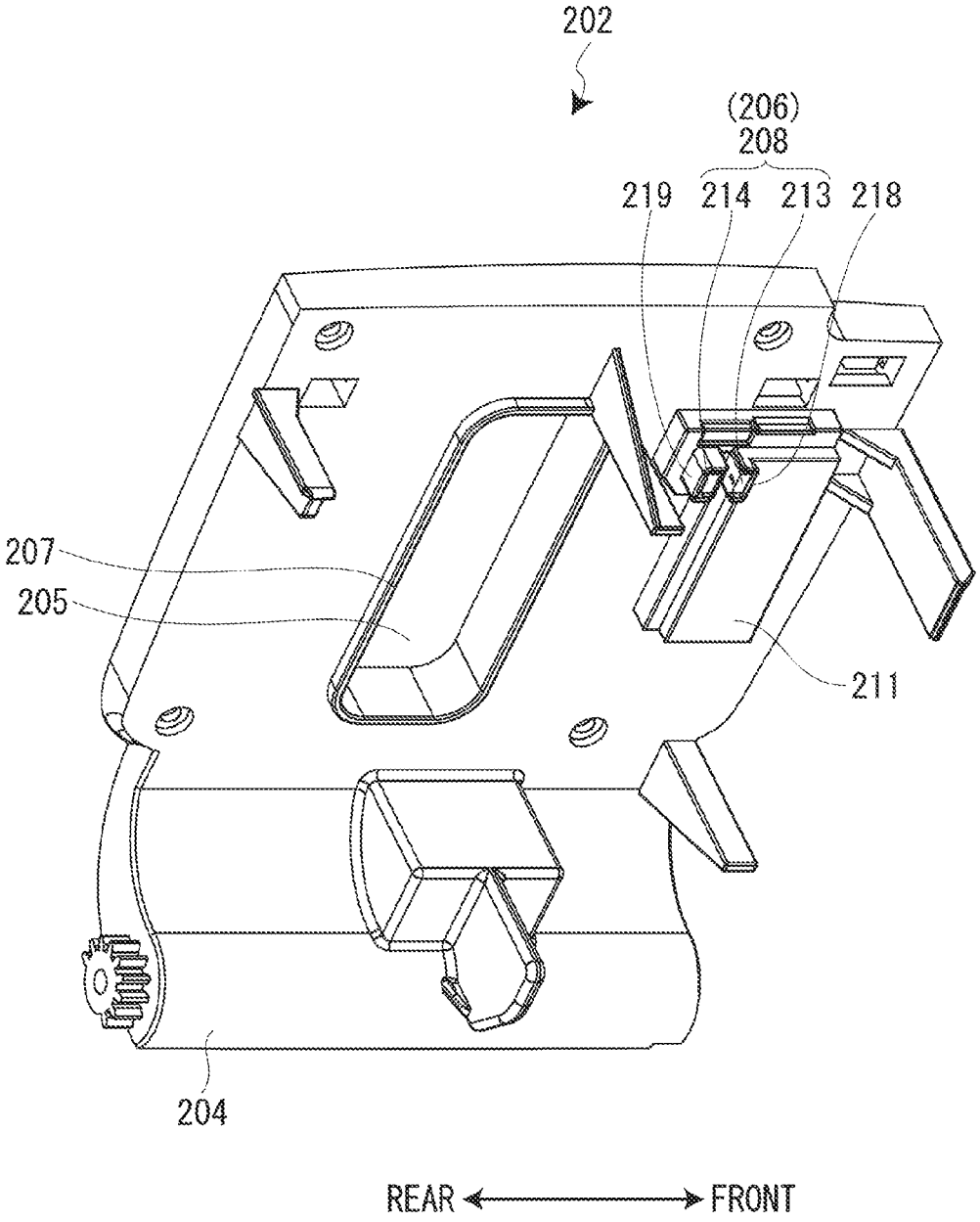
FIG. 8 is a perspective view of an opening/closing cover in a closed state when seen from its left lateral side.
Figure 9:
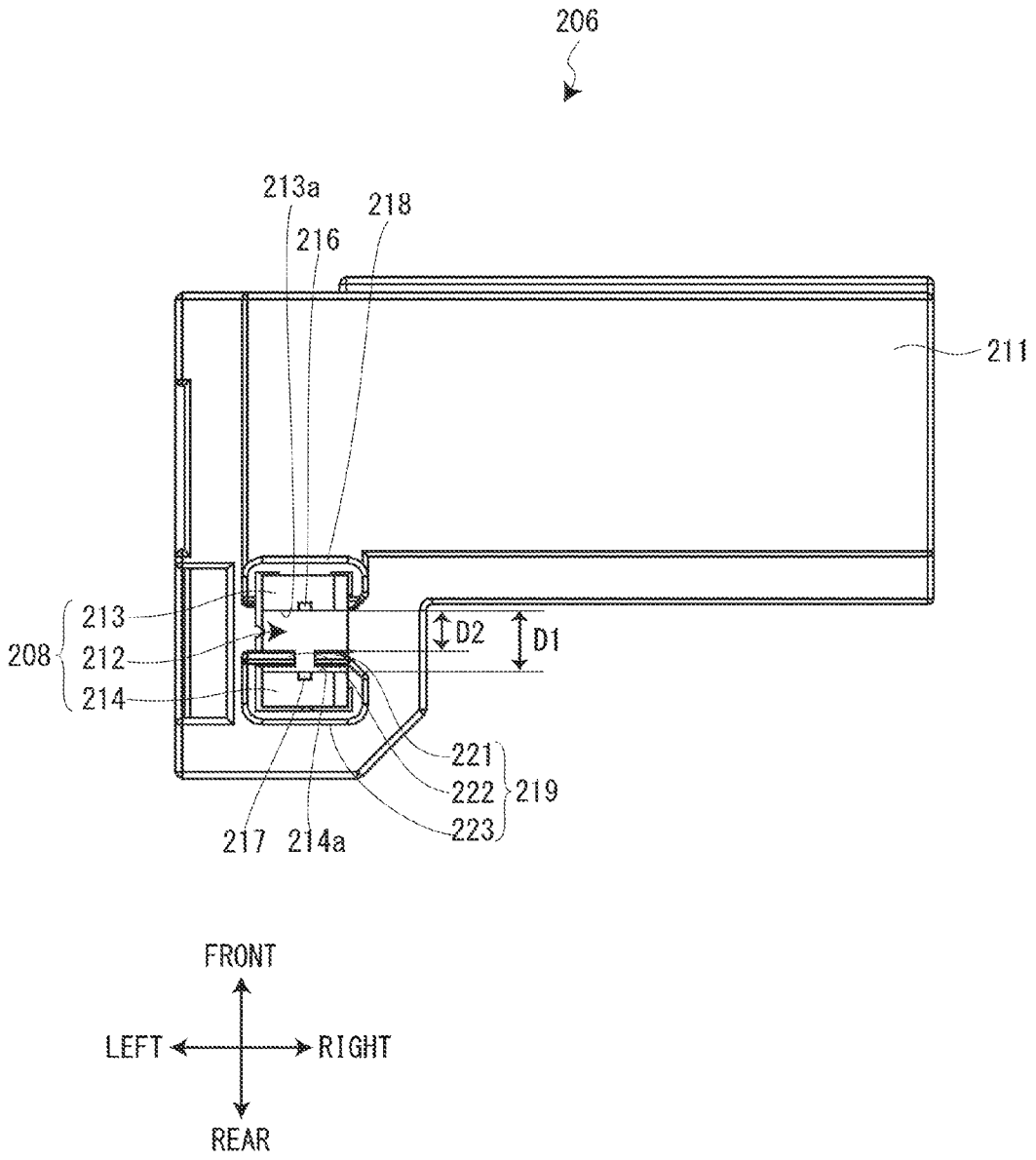
FIG. 9 is a bottom view of the opening/closing cover in the vicinity of a light sensor.

In this regard, in the tape cartridge 100 of the embodiment, the portion of the label tape 101 contacting the drawing prevention portion 138, i.e., the side of the second lateral portion 152 of the label tape 101 is curved like an "S"-shape in the front and rear direction, while the respective detection convex portions 109 do not contact the drawing prevention portion 138 and are formed into a substantially linear shape, for example, a gentle arc shape (see FIG. 7).

Accordingly, the respective detection convex portions 109 enter the light sensor 206 in a state of being formed into a substantially linear shape. Thus, compared with a case in which the respective detection convex portions 109 enter the light sensor 206 in a state of being curved like an "S"-shape, the respective detection convex portions 109 can appropriately enter the area between the light-emission element 216 and the light-reception element 217 without changing their entering path for each time. Therefore, since the passage position of the detection convex portions 109 in the direction in which the light-emission element 216 and the light-reception element 217 of the light sensor 206 face each other is secured, a change in output voltage at the passage due to a change in the passage position is reduced, whereby the light sensor 206 can appropriately detect the passage of the detection convex portions 109. In addition, in this case as well, since the side of the second lateral portion 152 of the label tape 101 is held between the platen roller 103 and the drawing prevention portion 138 when the platen roller 103 moves to the upstream side in the paying-out direction as the label tape 101 is drawn, the tip end of the label tape 101 can be prevented from getting in the cartridge case 104. Therefore, the light sensor 206 can appropriately detect the passage of the detection convex portions 109, while the tip end of the label tape 101 is prevented from getting in the cartridge case 104.

Note that in the embodiment, the drawing prevention portion 138 contacts the label tape 101 from the end of the side of the second lateral portion 152 of the label tape 101 to the midstream of the second tape width W2.

Moreover, the tip end of the drawing prevention portion 138 projecting from the bottom wall portion 117 is configured to be capable of elastically tilting in the direction away from the label tape 101. Therefore, when the label tape 101 is fed, the drawing prevention portion 138 is pressed by the label tape 101 fed in its tensed state and the tip end tilts in the direction away from the label tape 101. Accordingly, with this configuration, the side of the second lateral portion 152 of the label tape 101 corresponding to the base-end side of the drawing prevention portion 138 is curved like an "S"-shape but the side of the first lateral portion 151 of the label tape 101 corresponding to the tip-end side of the drawing prevention portion 138 is formed into a substantially linear shape, for example, a gentle arc shape on the feed path from the drawing prevention portion 138 to the platen roller 103. Therefore, the upper side of the label tape 101 can be further linearly shaped. Accordingly, the respective detection convex portions 109 can further appropriately enter and pass through the area between the light-emission element 216 and the light-reception element 217 of the light sensor 206.

In addition, as described above, in the tape cartridge 100 of the embodiment, the side of the second lateral portion 152 of the label tape 101 contacting the drawing prevention portion 138 is curved like an "S"-shape, but the side of the first lateral portion 151 of the label tape 101 having the plurality of detection convex portions 109 is formed into a substantially linear shape, for example, a gentle arc shape. Thus, compared with a case in which the label tape 101 is curved like an "S"-shape over the whole tape width, the print tape 106 hardly partially falls off from the backing tape 107 and thus is prevented from becoming wrinkled on the feed path from the drawing prevention portion 138 to the platen roller 103.

As described above, in the tape cartridge 100 of the embodiment, the respective detection convex portions 109 of the label tape 101 can appropriately enter the area between the light-emission element 216 and the light-reception element 217 of the light sensor 206.

Note that the above embodiment describes the configuration in which the drawing prevention portion 138 does not contact the top wall portion 115 as an example of a configuration in which the drawing prevention portion 138 does not contact the detection convex portions 109. However, the present invention is not limited to this, and the drawing prevention portion 138 may contact the top wall portion 115 unless contacting the detection convex portions 109. In addition, the drawing prevention portion 138 may be folded like a crank shape or a step shape in the direction away from the platen roller 103 (label tape 101) or may be curved like an arc shape so as to be away from the platen roller 103 toward the tip end. Moreover, the above embodiment exemplifies the label tape 101 having the plurality of label portions 105 as a tape-shaped member. However, the present invention is not limited to this and may include a configuration in which the label portions 105 are not provided.

EXPLANATION OF REFERENCE SYMBOLS

1: label creation apparatus
100: tape cartridge
200: apparatus main body

The invention claimed is:

1. A tape cartridge to be installed in a tape printing apparatus having a print head that performs printing on a print tape, the tape cartridge comprising:

a tape-shaped member that has the print tape and a release tape affixed to a rear side of the print tape;

a platen roller that is provided so as to be brought into rolling-contact with a side of the release tape of the tape-shaped member, feeds by rotation the tape-shaped member held between the platen roller and the print head, and moves, within a prescribed range in a tape feed direction as the tape-shaped member is paid out and drawn; and a drawing prevention portion that is provided at a position upstream of the platen roller in the tape feed direction and holds the tape-shaped member between the drawing prevention portion and the platen roller when the platen roller moves to an upstream side in the tape feed direction as the tape-shaped member is drawn, wherein the drawing prevention portion does not hold the tape-shaped member between the drawing prevention portion and the platen roller on one side in a tape width direction of the tape-shaped member when the platen roller moves to the upstream side in the tape feed direction.

2. The tape cartridge according to claim 1, wherein the tape cartridge has a covering wall portion that covers an end surface on the other side in the tape width direction of the tape-shaped member, and the drawing prevention portion projects from the covering wall portion and is configured to be shorter than a tape width of the tape-shaped member.

3. A tape printing apparatus comprising:

the tape cartridge according to claim 1;

a cartridge installation portion in which the tape cartridge is installed;

the print head that performs printing on the tape-shaped member; and a feed portion that rotates and drives the platen roller.

4. The tape printing apparatus according to claim 3, wherein the tape-shaped member has a plurality of detection target portions provided along a tape length direction at an end on the one side in the tape width direction, and the tape printing apparatus further includes a detection portion that is positioned between the drawing prevention portion and the platen roller in the tape feed direction and detects passage of the respective detection target portions.

5. A tape cartridge to be installed in a tape printing apparatus having a print head that performs printing on a print tape, the tape cartridge comprising:

a tape-shaped member that has the print tape and a release tape affixed to a rear side of the print tape;

a platen roller that is rotatably provided so as to be brought into rolling-contact with a side of the release tape of the tape-shaped member, feeds by rotation the tape-shaped member held between the platen roller and the print head, and moves within a prescribed range in a tape feed direction as the tape-shaped member is paid out and drawn; and a drawing prevention portion that is provided at a position upstream of the platen roller in the tape feed direction, contacts a side of the print tape of the tape-shaped member, and holds the tape-shaped member between the drawing prevention portion and the platen roller when the platen roller moves to an upstream side in the tape feed direction as the tape-shaped member is drawn, wherein the drawing prevention portion is supported on one side thereof and is configured to be capable of elastically tilting to a side opposite to the platen roller.

6. A tape cartridge to be installed in a tape printing apparatus, the tape cartridge comprising:

a tape-shaped member having a plurality of detection convex portions that partially projects from one end in a tape width direction;

a cartridge case that has a first wall portion and a second wall portion facing each other and accommodates the tape-shaped member so as to make a side of the one end of the tape-shaped member positioned on a side of the first wall portion and make a side of the other end thereof positioned on a side of the second wall portion;

a platen roller that serves as a roller rotatably accommodated in the cartridge case and paying out the tape-shaped member by rotation and is movable to an upstream side in a paying-out direction of the tape-shaped member as the tape-shaped member is drawn; and a drawing prevention portion that projects from the second wall portion at a position upstream of the platen roller in the paying-out direction of the tape-shaped member and holds the tape-shaped member between the drawing prevention portion and the platen roller when the platen roller moves to the upstream side in the paying-out direction of the tape-shaped member as the tape-shaped member is drawn, wherein the drawing prevention portion does not contact the detection convex portions.

7. The tape cartridge according to claim 6, wherein the drawing prevention portion does not contact the first wall portion.

8. The tape cartridge according to claim 7, wherein the drawing prevention portion is configured such that a tip end thereof is capable of elastically tilting in a direction away from the tape-shaped member.

9. The tape cartridge according to claim 6, wherein a length in the tape width direction of the drawing prevention portion is shorter than a length of the platen roller.

10. The tape cartridge according to claim 6, wherein the first wall portion has an exposed area in which the plurality of detection convex portions is exposed one after another as the tape-shaped member is paid out by the platen roller, and a rotation shaft of the platen roller is pivotally supported by platen engagement holes of the first wall portion and the second wall portion.

11. The tape cartridge according to claim 10, wherein the platen engagement hole of the first wall portion is provided in the exposed area.

12. A tape printing apparatus comprising:

the tape cartridge according to claim 6;

a cartridge installation portion in which the tape cartridge is installed;

the print head that performs printing on the tape-shaped member; and a feed portion that rotates and drives the platen roller.

13. The tape printing apparatus according to claim 12, wherein the tape-shaped member has a plurality of detection target portions provided along a tape length direction at an end on the one side in the tape width direction, and the tape printing apparatus further includes a detection portion that is positioned between the drawing prevention portion and the platen roller in the tape feed direction and detects passage of the respective detection target portions.

* * * * *